US010899573B2

(12) United States Patent
Furuhashi et al.

(10) Patent No.: US 10,899,573 B2
(45) Date of Patent: Jan. 26, 2021

(54) FOLDING DEVICE WITH SKEW CORRECTION

(71) Applicants: Tomohiro Furuhashi, Kanagawa (JP); Shinji Asami, Tokyo (JP); Michitaka Suzuki, Kanagawa (JP); Tomomichi Hoshino, Kanagawa (JP); Fumiharu Yoneyama, Kanagawa (JP); Makoto Hidaka, Tokyo (JP); Koki Sakano, Kanagawa (JP); Akira Kunieda, Tokyo (JP); Takuya Morinaga, Tokyo (JP); Yohsuke Haraguchi, Kanagawa (JP)

(72) Inventors: Tomohiro Furuhashi, Kanagawa (JP); Shinji Asami, Tokyo (JP); Michitaka Suzuki, Kanagawa (JP); Tomomichi Hoshino, Kanagawa (JP); Fumiharu Yoneyama, Kanagawa (JP); Makoto Hidaka, Tokyo (JP); Koki Sakano, Kanagawa (JP); Akira Kunieda, Tokyo (JP); Takuya Morinaga, Tokyo (JP); Yohsuke Haraguchi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/351,966

(22) Filed: Mar. 13, 2019

(65) Prior Publication Data

US 2019/0284011 A1 Sep. 19, 2019

(30) Foreign Application Priority Data

Mar. 19, 2018 (JP) ..... 2018-050397
Jan. 24, 2019 (JP) ..... 2019-010038

(51) Int. Cl.
*B65H 45/14* (2006.01)
*G03G 15/00* (2006.01)

(52) U.S. Cl.
CPC ..... *B65H 45/14* (2013.01); *G03G 15/6567* (2013.01); *B65H 2301/331* (2013.01); *G03G 2215/00877* (2013.01)

(58) Field of Classification Search
CPC .. B65H 45/14; B65H 2301/331; B65H 9/002; B65H 2801/27; B65H 45/142; G03G 15/6567
See application file for complete search history.

(56) References Cited

U.S. PATENT DOCUMENTS 6,315,288 B1 * 11/2001 Sugishima ..... B42C 1/12 270/58.11
6,332,606 B1 * 12/2001 Seki ..... B42C 1/12 270/58.08

(Continued)

FOREIGN PATENT DOCUMENTS

JP 2014-125312 7/2014
JP 2014125312 A * 7/2014 ..... B65H 29/145
JP 2015-016920 1/2015

*Primary Examiner* — Patrick H MacKey
(74) *Attorney, Agent, or Firm* — Harness, Dickey & Pierce, P.L.C.

(57) ABSTRACT

A sheet processing apparatus includes an entry portion, a sheet conveyance path extending from the entry portion, a skew correction roller pair that contacts a leading edge of a sheet conveyed in a predetermined direction from the entry portion to correct skew of the sheet, and a receiving path. The skew correction roller pair conveys the skew-corrected sheet in a direction opposite the predetermined direction. The receiving path branches from the sheet conveyance path from the entry portion to the skew correction roller pair to receive the sheet conveyed in the direction opposite the predetermined direction.

22 Claims, 26 Drawing Sheets

(56) References Cited

U.S. PATENT DOCUMENTS 7,896,341 B2 * 3/2011 Kunieda ..... B42C 1/12 270/58.08
7,900,905 B2 * 3/2011 Kiriyama ..... B42C 1/125 270/58.02
8,104,758 B2 * 1/2012 Tanaka ..... B65H 31/34 270/58.08
8,292,285 B2 * 10/2012 Yokoya ..... B65H 31/36 270/58.01
8,393,618 B2 * 3/2013 Nakada ..... B65H 7/08 271/227
8,511,665 B2 * 8/2013 Iwata ..... B65H 33/00 270/58.31
8,556,249 B2 * 10/2013 Ando ..... B42B 5/12 270/47
8,714,538 B2 * 5/2014 Miyake ..... B65H 31/34 270/58.09
9,016,679 B2 * 4/2015 Kunieda ..... B31F 1/10 270/32
9,428,355 B2 * 8/2016 Asai ..... B41J 13/0018
9,505,579 B2 * 11/2016 Ishikawa ..... B65H 29/125
9,533,853 B2 * 1/2017 Nakagawa ..... B65H 45/14
9,637,342 B2 * 5/2017 Hari ..... B65H 37/06
9,993,987 B2 * 6/2018 Suzuki ..... B31F 1/0025
10,059,558 B2 * 8/2018 Suzuki ..... B65H 45/14
10,105,968 B2 * 10/2018 Iwata ..... B41J 11/04
10,363,757 B2 * 7/2019 Iwata ..... B65H 29/58
2004/0126163 A1 7/2004 Asami et al.
2005/0000336 A1 1/2005 Hattori et al.
2006/0261544 A1 11/2006 Tamura et al.
2007/0108690 A1 * 5/2007 Hayashi ..... B65H 33/00 270/58.27
2007/0138726 A1 6/2007 Tamura et al.
2008/0224386 A1 9/2008 Kunieda et al.
2014/0141956 A1 5/2014 Suzuki et al.
2014/0147184 A1 5/2014 Kunieda et al.
2014/0171283 A1 * 6/2014 Furuhashi ..... B65H 45/04 493/416
2014/0179504 A1 6/2014 Nakada et al.
2014/0336031 A1 * 11/2014 Suzuki ..... B65H 45/04 493/442
2015/0266697 A1 9/2015 Saito et al.
2015/0336765 A1 * 11/2015 Sawada ..... B65H 45/14 493/434
2016/0060072 A1 3/2016 Watanabe et al.
2017/0341885 A1 11/2017 Suzuki et al.

* cited by examiner

FOLDING DEVICE WITH SKEW CORRECTION

CROSS-REFERENCE TO RELATED APPLICATIONS

This patent application is based on and claims priority pursuant to 35 U.S.C. § 119 to Japanese Patent Applications No. 2018-050397, filed on Mar. 19, 2018, and No. 2019-010038, filed on Jan. 24, 2019 in the Japanese Patent Office, the entire disclosure of which is hereby incorporated by reference herein.

BACKGROUND

Technical Field

This disclosure relates to a sheet processing apparatus and an image forming system incorporating the sheet processing apparatus.

Background Art

The image forming system is known that includes an image forming apparatus to form an image on a sheet and a sheet processing apparatus including a skew correction member to correct a sheet skew by contacting the sheet sent from the image forming apparatus and performing predetermined processing on the skew-corrected sheet.

SUMMARY

This specification describes an improved sheet processing apparatus that includes an entry portion, a sheet conveyance path extending from the entry portion, a skew correction roller pair that contacts a leading edge of a sheet conveyed in a predetermined direction from the entry portion to correct skew of the sheet, and a receiving path. The skew correction roller pair conveys the skew-corrected sheet in a direction opposite the predetermined direction. The receiving path branches from the sheet conveyance path from the entry portion to the skew correction roller pair to receive the sheet conveyed in the direction opposite the predetermined direction.

This specification further describes an improved image forming system that includes an image forming apparatus to form an image on a sheet, a sheet processing apparatus disposed in an internal ejection section of the image forming apparatus that ejects the sheet on which an image is formed in a space formed inside the image forming apparatus, and circuitry. The sheet processing apparatus includes an entry portion coupled to the image forming apparatus, a skew correction roller pair that contacts a leading edge of a sheet conveyed in a predetermined direction from the entry portion to correct skew of the sheet and conveys the skew-corrected sheet in a direction opposite the predetermined direction, a receiving path branched from a sheet conveyance path from the entry portion to the skew correction roller pair to receive the sheet conveyed in the direction opposite the predetermined direction, and a plurality of conveyance rollers to convey the sheet. After a leading edge of the sheet leaving an end portion in the image forming apparatus contacts the skew correction roller pair, the circuitry controls the plurality of conveyance rollers to convey a whole of the sheet in the sheet processing apparatus and controls the skew correction roller pair to convey the sheet in the direction opposite the predetermined direction to the receiving path.

This specification still further describes an improved image forming system that includes an image forming apparatus to form an image on a sheet and a sheet processing apparatus to overlay a following sheet sent from the image forming apparatus and leaving an end portion of the following sheet in the image forming apparatus on a preceding sheet and, subsequently, perform a predetermined process on the sheets.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
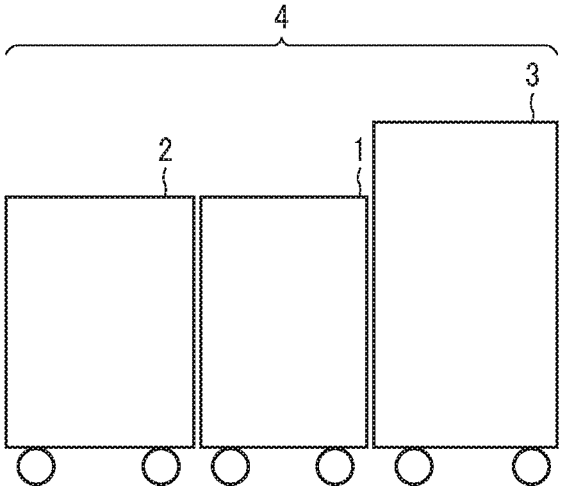
FIG. 1 is a schematic diagram illustrating a system configuration of an image forming system including an image forming apparatus and a plurality of sheet processing apparatuses according to embodiments of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

Although the embodiments are described with technical limitations with reference to the attached drawings, such description is not intended to limit the scope of the disclosure and all of the components or elements described in the embodiments of this disclosure are not necessarily indispensable.

Referring now to the drawings, embodiments of the present disclosure are described below. In the drawings illustrating the following embodiments, the same reference numbers are allocated to elements having the same function or shape and redundant descriptions thereof are omitted below.

FIG. 1 is a schematic diagram illustrating a system configuration of an image forming system 4, including an image forming apparatus according to an embodiment of the present disclosure and a plurality of sheet processing apparatuses. The image forming system 4 in the present embodiment includes a folding apparatus 1 and a post-processing apparatus 2, each of which serves as the sheet processing apparatus, provided in this order at later stages of the image forming apparatus 3, as illustrated in FIG. 1.

The image forming apparatus 3 forms an image on a sheet based on image data that is input to the image forming apparatus 3 or obtained by scanning. The image forming apparatus 3 may be, for instance, a copier, a printer, a facsimile machine, or a multifunction peripheral having at least two of these functions. The image forming apparatus 3 may use any known image forming method, such as electrophotography or droplet discharge. The image forming apparatus 3 in the present embodiment is a copier using the electrophotography.

Examples of the post-processing apparatus 2 include a punch apparatus that punches a hole in the sheet, a sheet binding apparatus in which a stapler or the like binds sheets and make a sheet bundle, and a sorter that sorts and ejects a sheet on which an image formed into each of a plurality of ejection trays.

Figure 2:
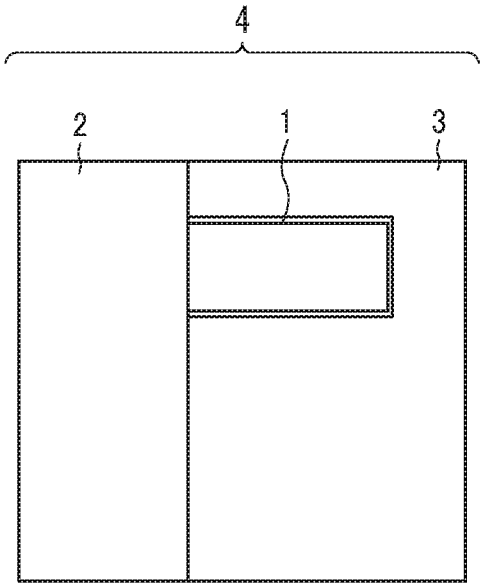
FIG. 2 is a schematic diagram illustrating another system configuration of the image forming system.

FIG. 2 is a schematic diagram illustrating another system configuration of the image forming system 4. The image forming system 4 illustrated in FIG. 2 is configured by the image forming apparatus 3 with a body covering the folding apparatus 1. The stitch perforation forming apparatus may be provided in the post-processing apparatus 2.

Figure 3:
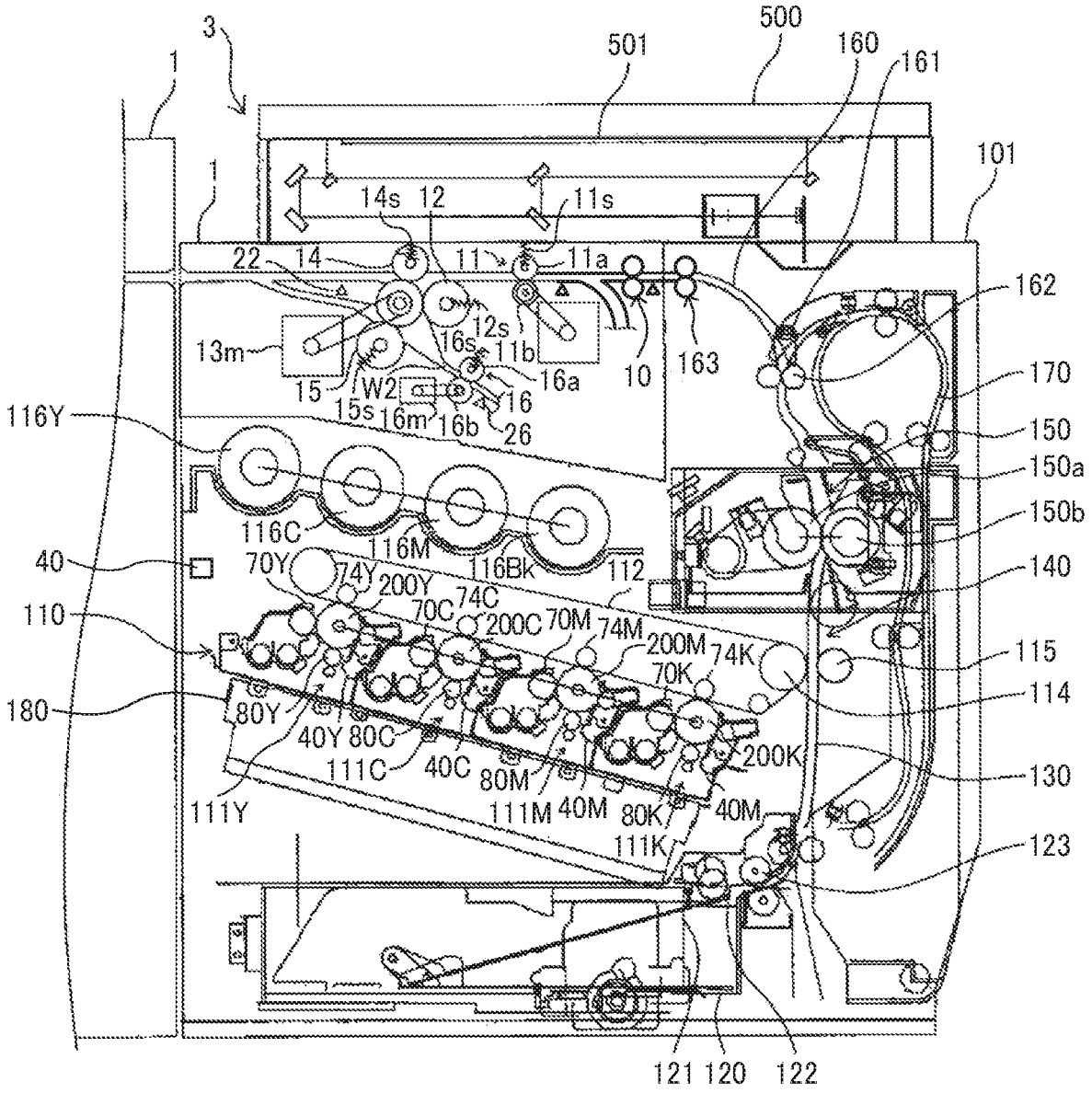
FIG. 3 is a schematic configuration diagram of the image forming apparatus provided in the image forming system of FIG. 1.

FIG. 3 is a schematic configuration diagram of the image forming apparatus 3 provided in the image forming system 4 according to the present embodiment. An image forming apparatus main body 101 is a tandem color image forming apparatus of intermediate transfer type. The image forming apparatus main body 101 includes an image forming unit 110 including four color image forming stations 111Y, 111C, 111M, and 111K arranged substantially at the center of the image forming apparatus main body 101 in FIG. 3. An optical writing device 180 is disposed adjacent to the lower side of the image forming unit 110. Under the optical writing device 180, a feeder 120 is disposed. The image forming apparatus main body 101 includes a feed conveyance path 130 to convey a sheet P fed from the feeder 120 to a secondary transfer section 140 and a fixing device 150. The feed conveyance path 130 is a vertical conveyance path. In addition, the image forming apparatus main body 101 includes an ejection conveyance path 160 to convey, to the folding apparatus 1, the sheet P on which an image is fixed in the fixing device 150 and a duplex copy conveyance path 170 to invert the sheet P having the image on one surface and form an image on the other surface of the sheet P.

The image forming unit 110 includes photoconductor drums 200Y, 200C, 200M, and 200K for respective colors of the image forming stations 111Y, 111C, 111M, and 111K. Chargers 80Y, 80C, 80M, and 80K, developing devices 70Y, 70C, 70M, and 70K, cleaning units 40Y, 40C, 40M, and 40K, and electric charge removing units are disposed along the outer peripheries of the photoconductor drums 200Y, 200C, 200M, and 200K, respectively. The image forming apparatus main body 101 also includes an intermediate transfer belt 112 onto which the images formed on the photoconductor drums 200Y, 200C, 200M, and 200K are transferred by primary transfer rollers 74Y, 74C, 74M, and 74K and the optical writing device 180 to write respective color images on the photoconductor drums 200Y, 200C, 200M, and 200K.

The optical writing device 180 is disposed below the image forming stations 111Y, 111C, 111M and 111K, and the intermediate transfer belt 112 is disposed above the image forming stations 111Y, 111C, 111M and 111K. Toner storage containers 116Y, 116C, 116M, and 116K containing toner for replenishing to the developing devices 70Y, 70C, 70M, and 70K are disposed above the image forming unit 110 in an exchangeable manner.

As illustrated in FIG. 3, the intermediate transfer belt 112 is rotatably supported by a plurality of support rollers. One support roller 114 of the plurality of support rollers is opposite a secondary transfer roller 115 via the intermediate transfer belt 112 in a secondary transfer section 140, which enables the image on the intermediate transfer belt 112 to secondarily transfer to the sheet P.

Meanwhile, an image forming process performed by a tandem color image forming apparatus using an indirect transfer method is known and is not directly related to the present disclosure; accordingly, a detailed description thereof is omitted herein.

The feeder 120 includes a sheet feed tray 121, a pick-up roller 122, and a feeding conveyance roller 123 and feeds the sheet P picked up from the sheet feed tray 121 upward along the feed conveyance path 130.

An image is transferred to the fed sheet P in the secondary transfer section 140, and the sheet P is fed into the fixing device 150. The fixing device 150 includes a fixing roller 150*a* and a pressure roller 150*b*, and heat and pressure are applied in a process in which the sheet P passes through the nip between the fixing roller 150*a* and the pressure roller 150*b*, and the toner is fixed on the sheet P.

Downstream from the fixing device 150, the ejection conveyance path 160 and the duplex copy conveyance path 170 are disposed, both of which are branched in two directions by a bifurcating claw 161 that selects whether the sheet P is conveyed to a conveyance path to the folding apparatus 1 or the duplex copy conveyance path 170.

Bifurcating conveyance rollers 162 are disposed immediately upstream of the bifurcating claw 161 in a sheet conveyance direction to apply a conveyance force to the sheet.

The folding apparatus 1 is disposed in an internal ejection section in the image forming apparatus main body 101, folds the image formed sheet P conveyed from the image forming apparatus main body 101, and ejects the sheet P to the post-processing apparatus 2.

The image scanner 500 is a known apparatus that scans a document placed on an exposure glass 501 with light to read an image on the document. The configuration and function of the image scanner 500 are known and are not directly related to the present disclosure; accordingly, a detailed description thereof is omitted herein.

In the image forming apparatus main body 101 configured as described above, image data to use image writing is generated based on original document data read by the image scanner 500 or print data sent from an outer personal computer (PC). Based on the data, the optical writing device 180 optically writes an electrostatic latent image on each of the photoconductor drums 200Y, 200C, 200M, and 200K. Respective color images formed in the image forming stations 111Y, 111C, 111M, and 111K are successively transferred onto the intermediate transfer belt 112, and a color image on which four color images are superimposed is formed on the intermediate transfer belt 112.

On the other hand, the sheet P is fed from the sheet feed tray 121 in accordance with the image formation. The sheet P is temporarily stopped at a position of a registration roller right in front of the secondary transfer section 140, is fed in synchronization with a leading edge of an image on the intermediate transfer belt 112, is secondarily transferred by the secondary transfer section 140, and is fed into the fixing device 150.

The sheet P on which the image is fixed by the fixing device 150 is conveyed, by the switching operation of the bifurcating claw 161, to the ejection conveyance path 160 after single-sided printing and completion of duplex printing. Or the sheet P is conveyed to the duplex copy conveyance path 170 after single-sided printing of the duplex printing.

The sheet P conveyed to the duplex copy conveyance path 170 is inverted, conveyed to the secondary transfer section 140 again, and, after an image is formed on the other surface of the sheet P, returned to the ejection conveyance path 160.

The sheet P conveyed to the ejection conveyance path 160 is conveyed to the folding apparatus 1, folded by the folding apparatus 1, or ejected to the post-processing apparatus 2 without folding processing. A controller 40 controls the operation of the above-described parts and the operation of parts described later.

Figure 4:
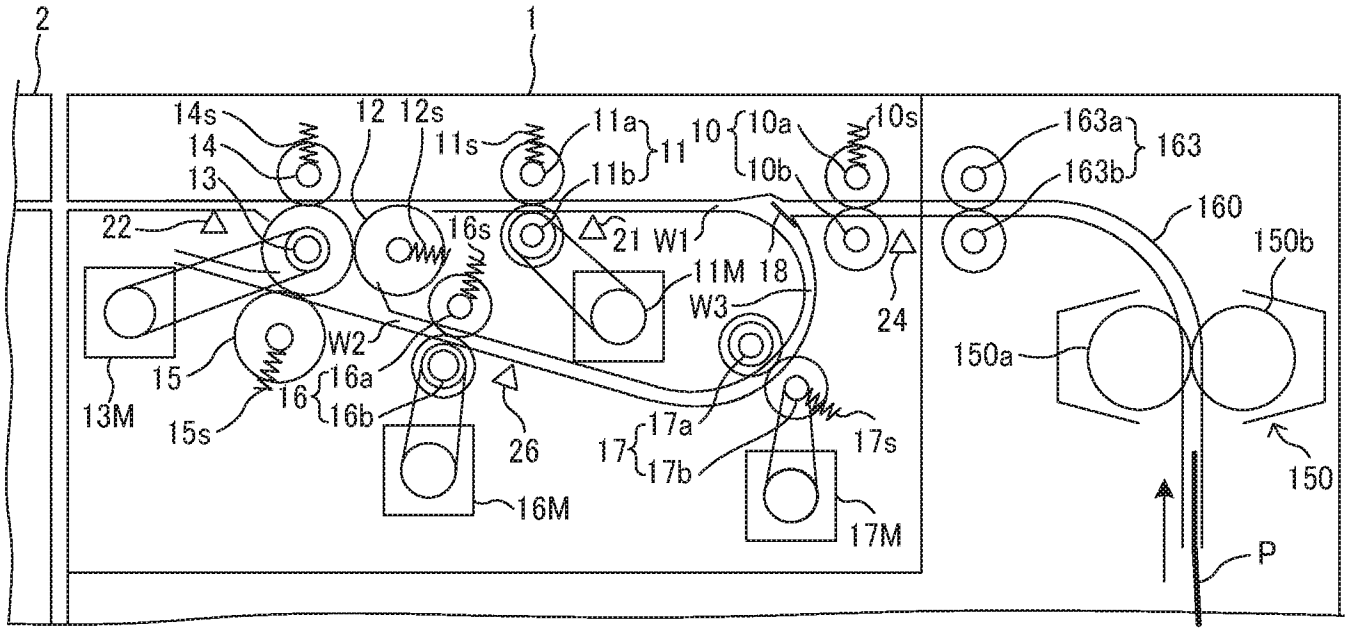
FIG. 4 is a schematic configuration diagram of a folding apparatus provided in the image forming system of FIG. 1.

FIG. 4 is a schematic configuration diagram of the folding apparatus 1 provided in the image forming system 4 according to the embodiment. The folding apparatus 1 according to the present embodiment includes a through-conveyance path W1 to convey the sheet P ejected from the image forming apparatus 3 to the post-processing apparatus 2 at the subsequent stage without the folding processing. In addition, the folding apparatus 1 includes a bifurcation conveyance path W2 that branches from the through-conveyance path W1, folds the sheet P ejected from the image forming apparatus 3, and conveys the sheet P to the post-processing apparatus 2 at the subsequent stage. The folding apparatus 1 includes a switchback conveyance path W3 serving as a receiving portion that branches from the through-conveyance path W1 to temporarily hold the sheet P conveyed in a reverse direction, overlay the following sheet ejected from the image forming apparatus 3, and convey the sheets.

An entry roller pair 10 is disposed on the right side of the folding apparatus 1 in FIG. 4, that is, in an entrance side of the through-conveyance path W1 that receives the sheet P ejected from the image forming apparatus 3. The entry roller pair includes an entry pressing roller 10*a* that is a rotating member and an entry driving roller 10*b* that is an opposing member. A driving force of the entry motor 10*m* that is a driving source drives and rotates the driving roller 10*b*.

In addition, a skew correction roller pair 11 serving as a first conveyer is disposed downstream from the entry roller pair 10 on the through-conveyance path W1. The skew correction roller pair 11 includes a skew correction pressing roller 11*a* that is a rotating member and a skew correction driving roller 11*b* that is an opposing member. A driving force of a skew motor 11M that is a driving source rotatable in reverse drives and rotates the skew correction driving roller 11*b*.

In addition, there is a first folding roller 12, a first forward and reverse rotation roller 13 disposed in contact with the first folding roller 12, and a pressing roller 14 disposed in contact with the first forward and reverse rotation roller 13 on an exit side, which is the left side in FIG. 4, of the through-conveyance path W1. The sheet P passes through a nip between the first folding roller 12 and the first forward and reverse rotation roller 13 to move from the through-conveyance path W1 to the bifurcation conveyance path W2. Or the sheet P passes through a nip between the first forward and reverse rotation roller 13 and the pressing roller 14 via the through-conveyance path W1 to convey the sheet P to the post-processing apparatus 2 at the subsequent stage.

Additionally, in the present embodiment, a second folding roller 15 is disposed in contact with the first forward and reverse rotation roller 13 on an exit side of the bifurcation conveyance path W2. On the bifurcation conveyance path W2, the second forward and reverse rotation roller pair 16 is disposed opposite the second folding roller 15 with respect to the nip between the first folding roller 12 and the first forward and reverse rotation roller 13 to which the sheet p enters from the through-conveyance path W1. The second forward and reverse rotation roller pair 16 includes a second forward and reverse pressing roller 16*a* that is a rotating member and a second forward and reverse driving roller 16*b* that is an opposing member. A driving force of a second motor 16M that is a driving source rotatable in reverse drives and rotates the second forward and reverse driving roller 16*b*.

A driving force of a first motor 13M can drive and rotate the first forward and reverse rotation roller 13 so that the first forward and reverse rotation roller 13 can rotate forward and reverse. All of the first folding roller 12, the pressing roller 14 and the second folding roller 15 which are disposed in contact with the first forward and reverse rotation roller 13 are driven rollers that are driven to rotate by the first forward and reverse rotation roller 613.

The driving force of the second motor 16M that is rotatable in reverse can drive and rotate the second forward and reverse rotation driving roller 16*b* that configures the second forward and reverse rotation roller pair 16. The second forward and reverse pressing roller 16*a* of the second forward and reverse rotation roller pair 16 is a driven roller that is driven to rotate by the second forward and reverse driving roller 16*b*.

Additionally, in the present embodiment, a switchback conveyance roller pair 17 is disposed on the switchback conveyance path W3. The switchback conveyance roller pair 17 includes a switchback conveyance pressing roller 17*a* that is a rotating member and a switchback conveyance driving roller 17*b* that is an opposing member. A driving force of a switchback motor 17M that is a driving source drives and rotates the switchback conveyance forward and reverse driving roller 17*b*.

In addition, a film 18 is disposed at a fork between the switchback conveyance path W3 and the through-conveyance path W1. The leading end of the film 18 is set on the side of the through-conveyance path W1 as illustrated in FIG. 4.

The pressure springs 10*s*, 11*s*, 12*s*, 14*s*, 15*s*, 16*s* and 17*s* serving as the pressure members press roller shafts of all driven rollers 10*a*, 11*a*, 12, 14, 15, 16*a*, and 17*b* to form nips between the driven rollers 10*a*, 11*a*, 12, 14, 15, 16*a*, and 17*b* and the respective opposing rollers.

In the present embodiment, an entry sensor 24 as a sheet end detector to detect the end of the sheet P is disposed on the upstream side of the entry roller pair 10 in the sheet conveyance direction, which is the entrance side of the through-conveyance path W1. The entry sensor 24 outputs to a controller a detection signal indicating that the leading edge and trailing edge of the sheet P conveyed from the image forming apparatus 3 reaches the detection area of the entry sensor 24. As the entry sensor 24, a known sensor can be used.

A skew sensor 21 as a sheet end detector to detect the end of the sheet P is disposed on the upstream side of the skew correction roller pair 11 in the sheet conveyance direction, which is near the center of the through-conveyance path W1. The skew sensor 21 outputs to a controller a leading-edge detection signal indicating that the leading edge of the sheet P conveyed from the image forming apparatus 3 reaches the detection area of the skew sensor 21. As the skew sensor 21, a known sensor can be used.

In the present embodiment, a sheet detector 22 functioning as a sheet leading edge detector to detect the leading edge of the sheet P is disposed on the downstream side of the second conveyer configured by the first forward and reverse rotation roller 13 and the pressing roller 14 in the sheet conveyance direction, which is the exit side of the through-conveyance path W1. The sheet detector 22 outputs to the controller a leading-edge detection signal indicating that the leading edge of the sheet P conveyed from the through-conveyance path W1 reaches the detection area of the sheet detector 22. Similar to the above-described skew sensor 21, as the sheet detector 22, a known sensor can be used.

In the present embodiment, a sheet detector 26 to detect the leading edge of the sheet P is disposed downstream from the second forward and reverse rotation roller pair 16 in the sheet conveyance direction, which is opposite side of the exit of the bifurcation conveyance path W2. The sheet detector 26 outputs the controller a leading-edge detection signal indicating that the leading edge of the sheet P conveyed from the through-conveyance path W1 to the bifurcation conveyance path W2 reaches the detection area of the sheet detector 26. Similar to the entry sensor 24, the skew sensor 21, and the sheet detector 22 which are described above, a known sensor can be used as the sheet detector 26.

In the present embodiment, a second conveyance unit is configured by the first forward and reverse rotation roller 13 and the pressing roller 14, and a folded portion forming unit is configured by the first folding roller 12 and the first forward and reverse rotation roller 13. Additionally, in the present embodiment, the folded portion forming unit is configured by the first forward and reverse rotation roller 13 and the second folding roller 15.

As the second conveyance unit, an adhesion roller or an attraction belt may be adopted instead of the above-described roller pair. In the present embodiment, the second conveyance unit including the first forward and reverse rotation roller 13 and the folded portion forming unit including the first forward and reverse rotation roller 13 and the second folding roller 15 has the common roller. However, the second conveyance unit and the folded portion forming unit are not limited by the above-described configuration and may be an independent structure configured by different rollers.

In the present embodiment, the switchback conveyance path W3 is connected to the bifurcation conveyance path W2. This can reduce a size of the folding apparatus 1 because it is possible to double the conveyance path of the sheet entering the second forward and reverse rotation roller pair 16 on the bifurcation conveyance path W2 and a part of the switchback conveyance path W3.

Next, a flow and operation of the folding processing for forming the folded portion on the sheet P by the folding apparatus 1 is described. FIGS. 5A to 5D are explanatory diagrams illustrating an example of folded portions formed by folding processing performed by the folding apparatus 1 in the present embodiment.

Figure 5A:
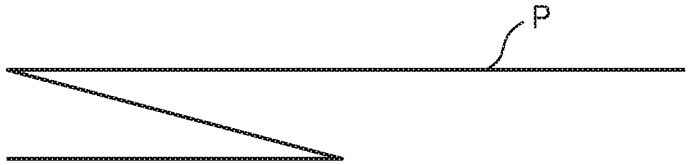
FIGS. 5A to 5D are explanatory diagrams illustrating an example of folded portions formed by folding processing performed by a folding apparatus.
Figure 5B:
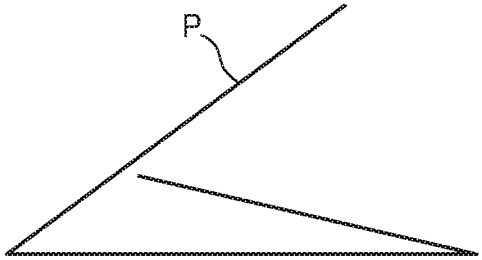
Figure 5C:
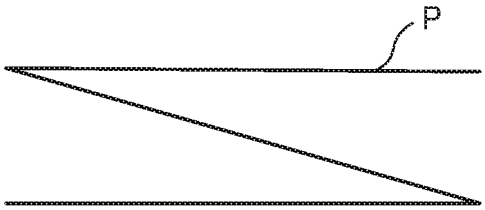
Figure 5D:
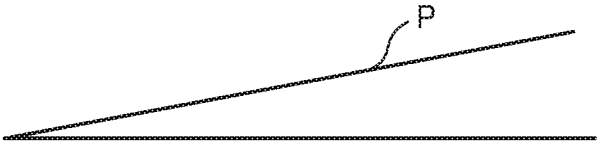

The folding apparatus 1 of the present embodiment can form two outer folded portions for the sheet P to perform Z-folding processing that folds the sheet P like a letter Z as illustrated in FIG. 5A. Additionally, the folding apparatus 1 of the present embodiment can form two inner folded portions that substantially divides the sheet P equally among three to perform inner three-fold processing that folds the sheet P one third inward as illustrated in FIG. 5B. Additionally, the folding apparatus 1 of the present embodiment can form two outer folded portions that substantially divide the sheet P equally among three to perform outer three-fold processing that folds the sheet P one third outward as illustrated in FIG. 5C. Additionally, the folding apparatus 1 of the present embodiment can form one folded portion that substantially divides the sheet P in half to perform two-fold processing that folds the sheet P in half as illustrated in FIG. 5D.

FIGS. 6A to 6H are explanatory diagrams illustrating a general operation when the folding apparatus 1 performs Z-folding processing.

Figure 6A:
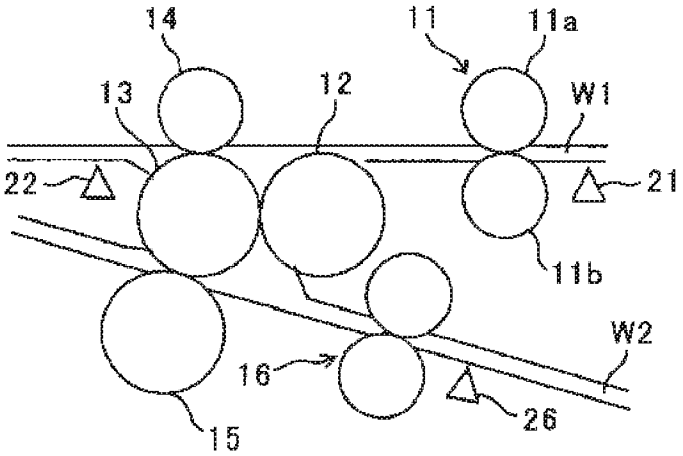
FIGS. 6A to 6H are explanatory diagrams illustrating a general operation when the folding apparatus performs Z-folding processing.
Figure 6B:
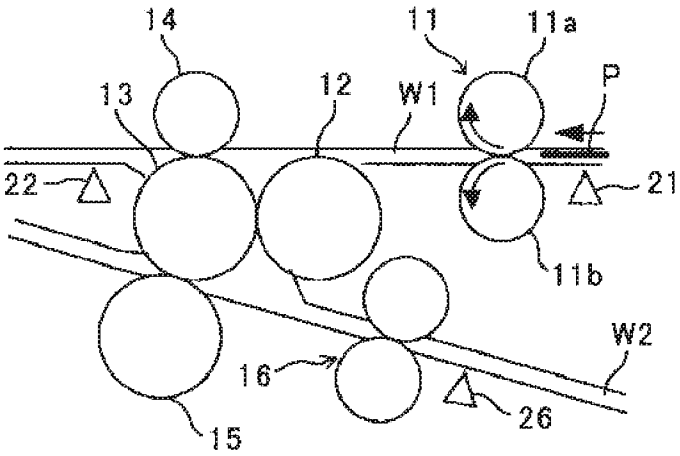

Firstly, the skew sensor 21 detects the leading edge of the sheet P delivered from the ejection roller in the image forming apparatus 3 to the entry roller pair 10 and given a conveyance force by the entry roller pair 10 to be conveyed in a predetermined direction, which is called a regular conveyance. The controller receives the leading-edge detection signal output from the skew sensor 21 and controls the skew motor 11M to start rotations of the skew correction roller pair 11 as illustrated in FIGS. 6A and 6B. When the leading edge of the sheet P enters the nip of the skew correction roller pair 11 after a start of the rotations of the skew correction roller pair 11, the skew correction roller pair 11 also gives the sheet P the conveyance force and conveys the sheet P on the through-conveyance path W1 to the exit side.

Figure 6C:
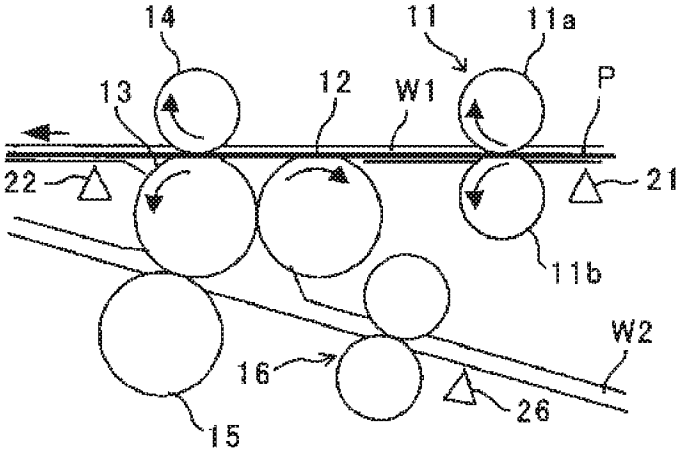

The leading edge of the sheet P conveyed on the through-conveyance path W1 enters the nip between the first forward and reverse rotation roller 13 and the pressing roller 14. After the leading edge of the sheet P passes through the nip, the sheet detector 22 detects the leading edge of the sheet P. The controller 40 receives the leading-edge detection signal from the sheet detector 22 which has detected the leading edge of the sheet P and performs the following control. That is, the controller 40 controls the first motor 13M to stop the rotation of the first forward and reverse rotation roller 13 when leading edge of the sheet P protrudes by a predetermined protrusion amount from the nip between the first forward and reverse rotation roller 13 and the pressing roller 14 as illustrated in FIG. 6C. At the same time, the controller 40 controls the skew motor 11M to stop the rotation of the skew correction driving roller 11*b* of the skew correction roller pair 11.

The protrusion amount is set depending on the length of the sheet P in the sheet conveyance direction and the content of the folding processing, such as the manner of folding. The controller can obtain the protrusion amount of the leading edge of the sheet P from, for example, a rotation amount of the pressing roller 14 from when the controller receives the leading-edge detection signal output from the sheet detector 22.

Figure 6D:
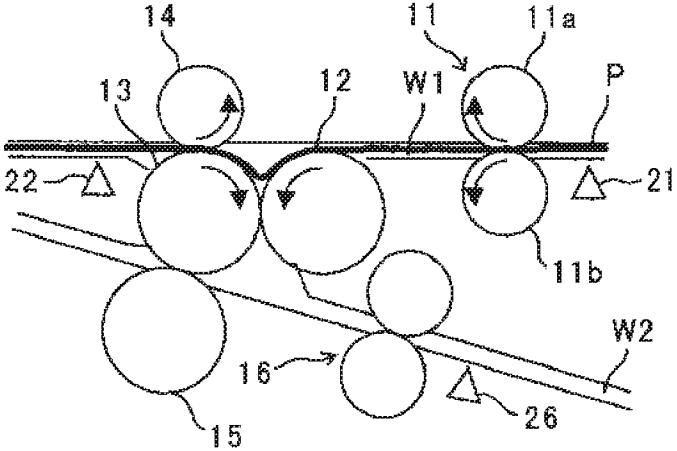
Figure 6E:
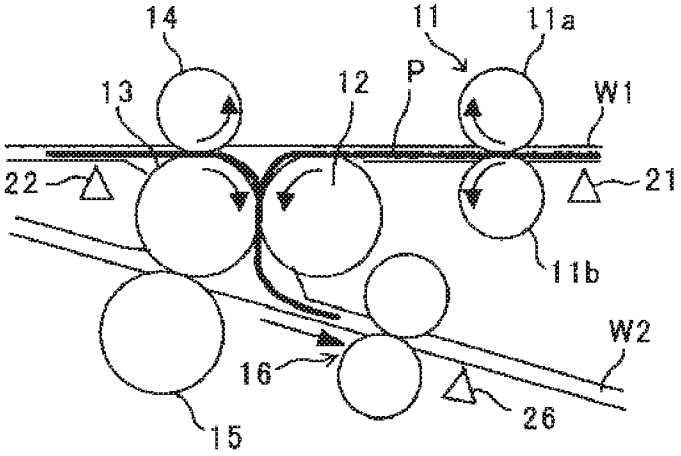

After the sheet P protrude by the predetermined protrusion amount, the controller controls the first motor 13M to start a reverse rotation of the first forward and reverse rotation roller 13 which returns the sheet P to the entrance side of the through-conveyance path W1 and the skew motor 11M to start the rotation of the skew correction roller pair 11. As illustrated in FIG. 6D, the reverse rotation of the first forward and reverse rotation roller 13 and the rotation of the skew correction roller pair 11 forms a bend of the sheet between the skew correction roller pair 11 and the first forward and reverse rotation roller 13. The bend of the sheet, that is, a folded back portion, enters the nip between the first folding roller 12 and the first forward and reverse rotation roller 13, and the first folded portion is formed at the folded back portion. As illustrated in FIG. 6E, the first folded portion passes through the nip between the first folding roller 12 and the first forward and reverse rotation roller 13, enters the bifurcation conveyance path W2, and is conveyed to the second forward and reverse rotation roller pair 16 on the bifurcation conveyance path W2.

Figure 6F:
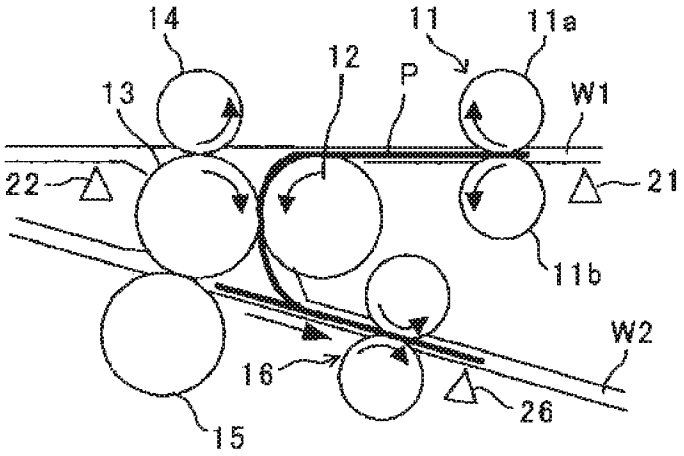

The first folded portion of the sheet P enters a nip of the second forward and reverse rotation roller pair 16 and is detected by the sheet detector 26 after the first folded portion passes through the nip. The controller 40 receives the leading-edge detection signal from the sheet detector 26 which has detected the leading edge of the sheet P and performs the following control. That is, the controller 40 controls the first motor 13M to stop the rotation of the first forward and reverse rotation roller 13 when the first folded portion of the sheet P protrudes by a predetermined protrusion amount from a position of the nip between the second forward and reverse rotation roller pair 16 as illustrated in FIG. 6F. At the same time, the controller 40 controls the second motor 16M and the skew motor 11M to stop the rotation of the second forward and reverse rotation roller pair 16 and the skew correction roller pair 11. The protrusion amount is also set depending on the length of the sheet P in the sheet conveyance direction and the content of the folding processing, such as the manner of folding. The controller can obtain the protrusion amount of the first folded portion of the sheet P from, for example, a rotation amount of the second forward and reverse rotation roller pair 16 from when the controller 40 receives the leading-edge detection signal output from the sheet detector 26.

Figure 6G:
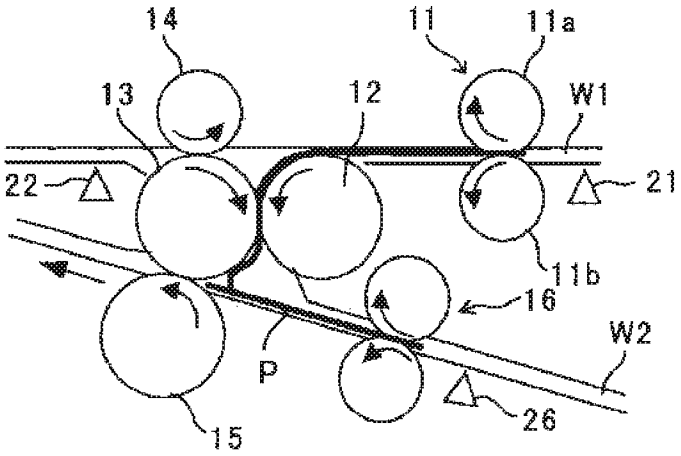

After the sheet P protrudes by the predetermined protrusion amount, the controller 40 controls the second motor 16M to start a reverse rotation of the second forward and reverse rotation roller pair 16 which conveys the sheet P to the exit side of the bifurcation conveyance path W2, the first motor 13M to start the reverse rotation of the first forward and reverse rotation roller 13 again, and the skew motor 11M to start the rotation of the skew correction roller pair 11 again. As illustrated in FIG. 6G, this operation forms a bend of the sheet between the first forward and reverse rotation roller 13 and the second forward and reverse rotation roller pair 16. The above-described bend of the sheet, that is, a folded back portion, enters the nip between the first forward and reverse rotation roller 13 and the second folding roller 15, and the second folded portion is formed at the folded back portion.

Figure 6H:
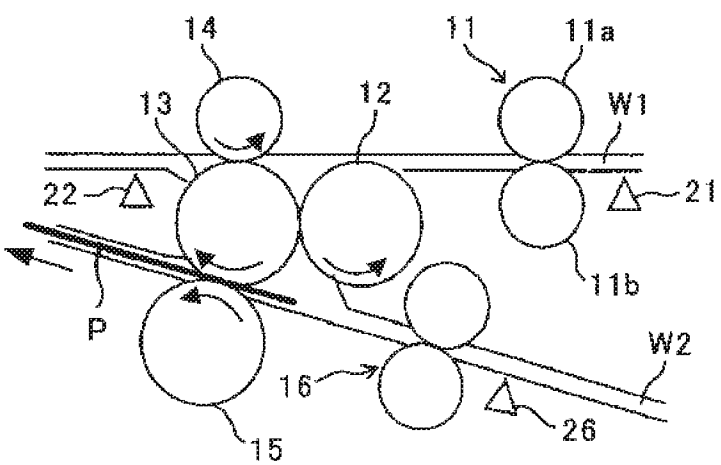
Figure 7A:
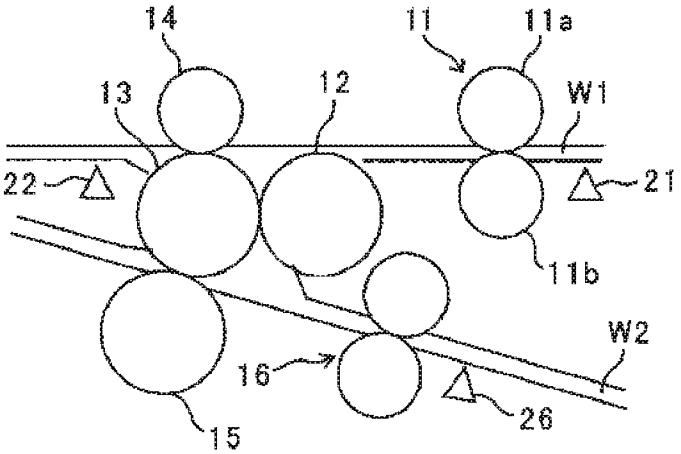
FIGS. 7A to 7H are explanatory diagrams illustrating a general operation when the folding apparatus performs inner three-fold processing.
Figure 7B:
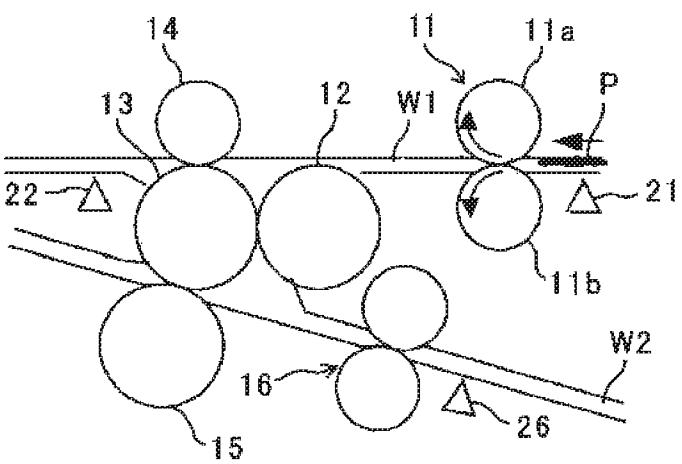
Figure 7C:
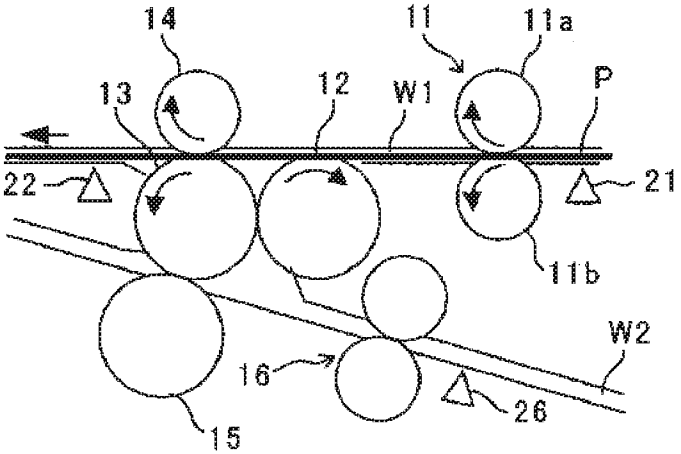
Figure 7D:
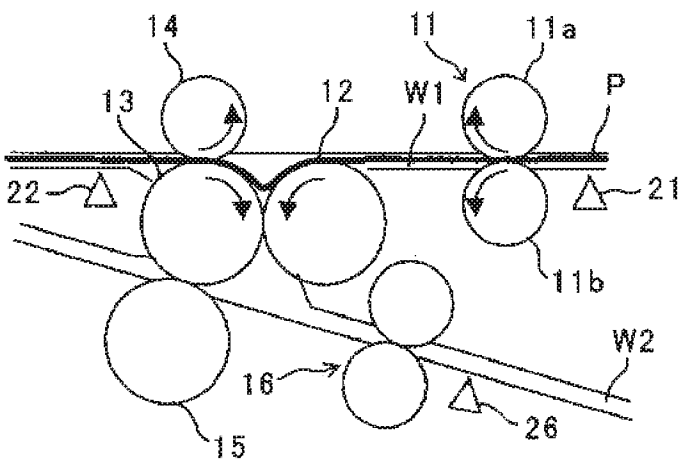
Figure 7E:
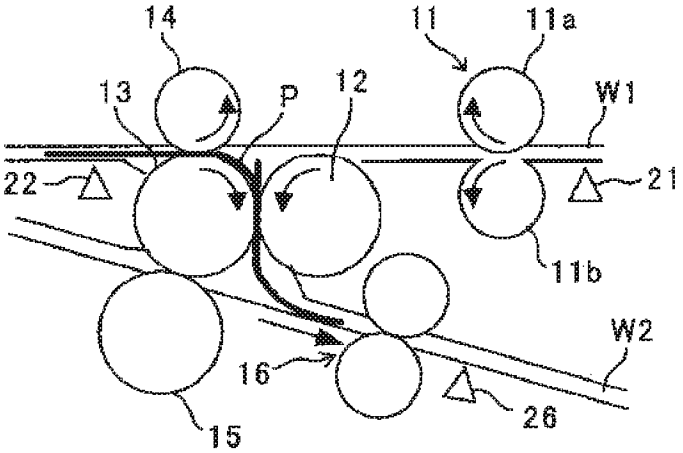
Figure 7F:
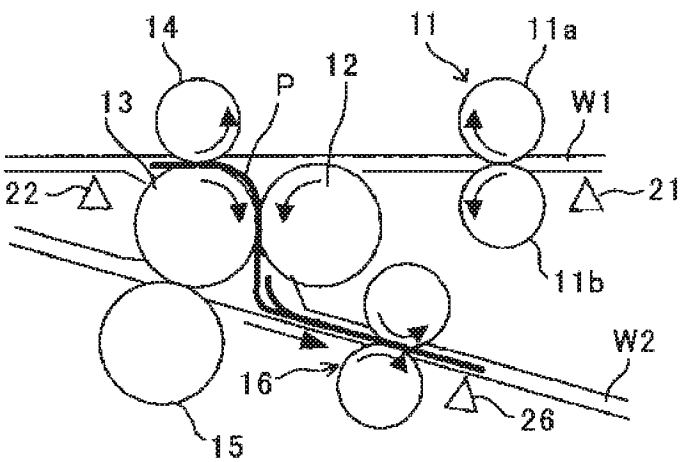
Figure 7G:
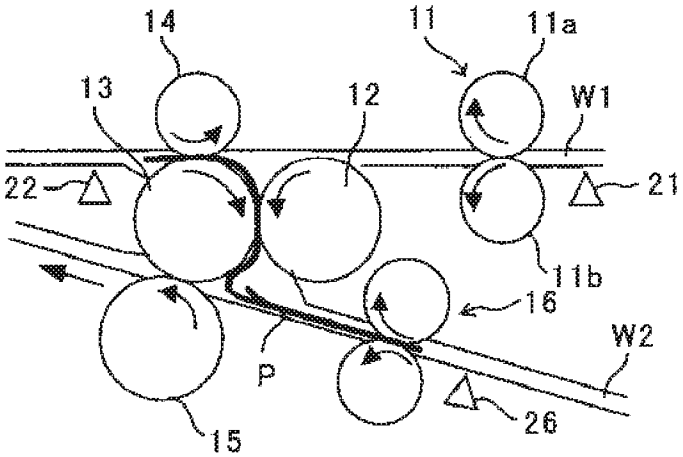
Figure 7H:
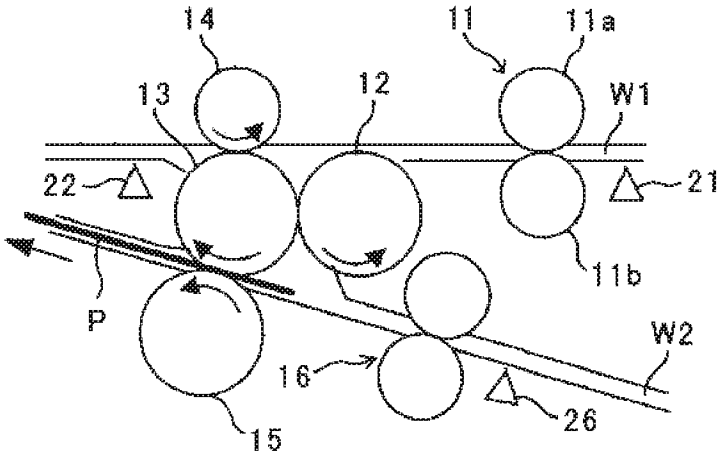
Figure 8A:
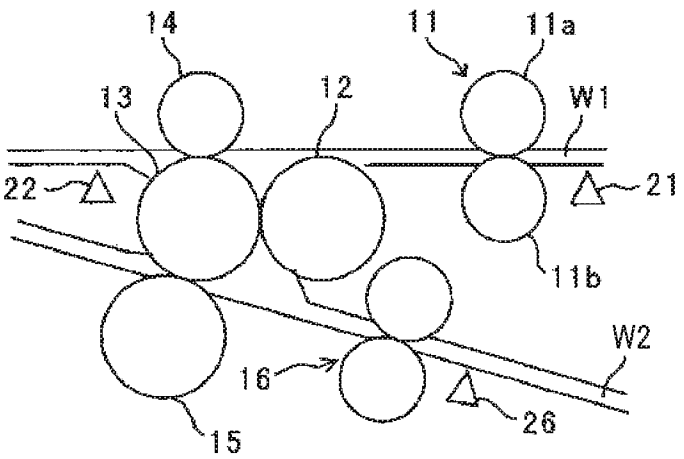
FIGS. 8A to 8H are explanatory diagrams illustrating a general operation when the folding apparatus performs outer three-fold processing.
Figure 8B:
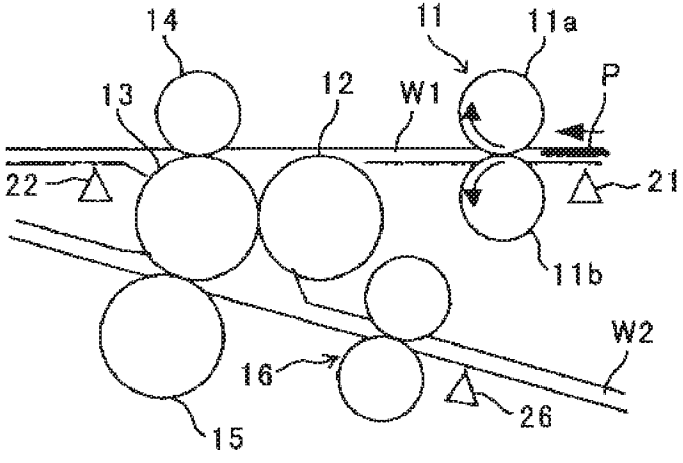
Figure 8C:
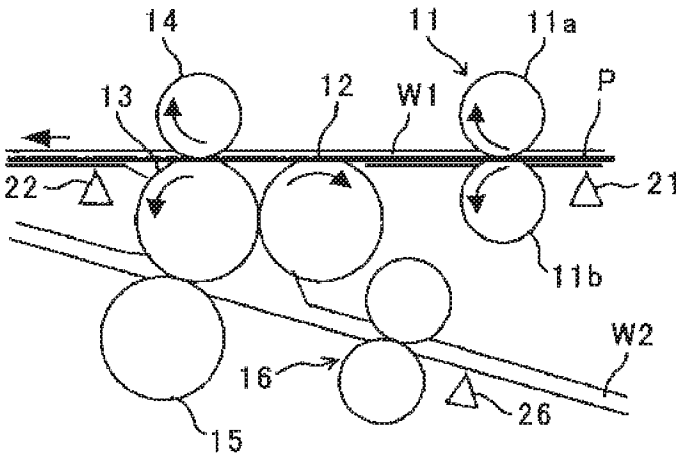
Figure 8D:
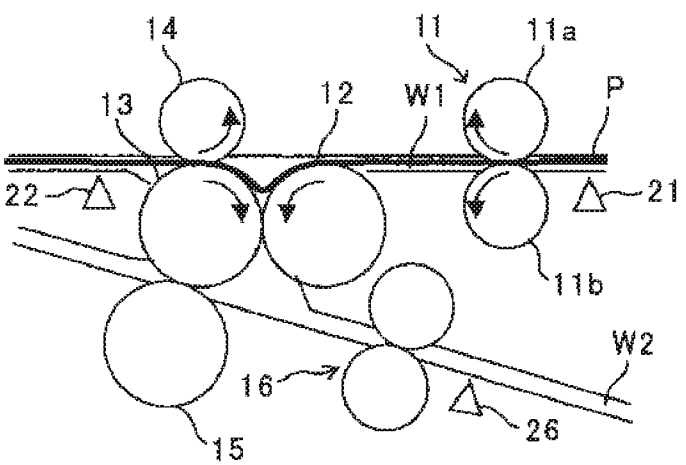
Figure 8E:
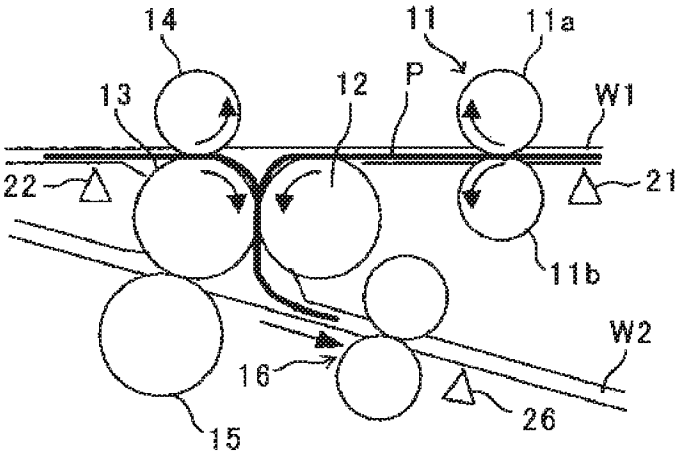
Figure 8F:
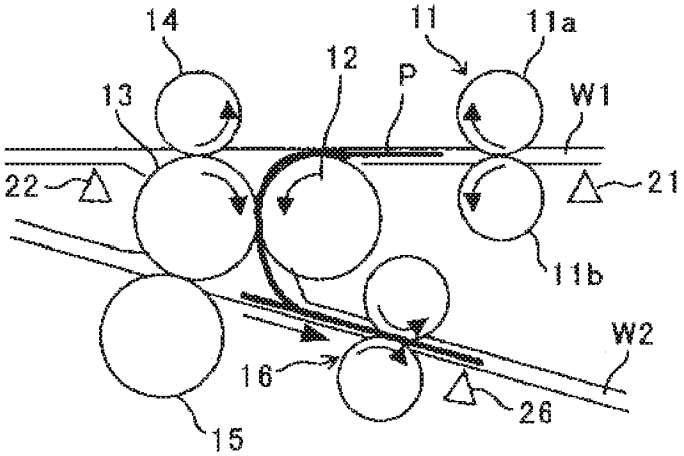
Figure 8G:
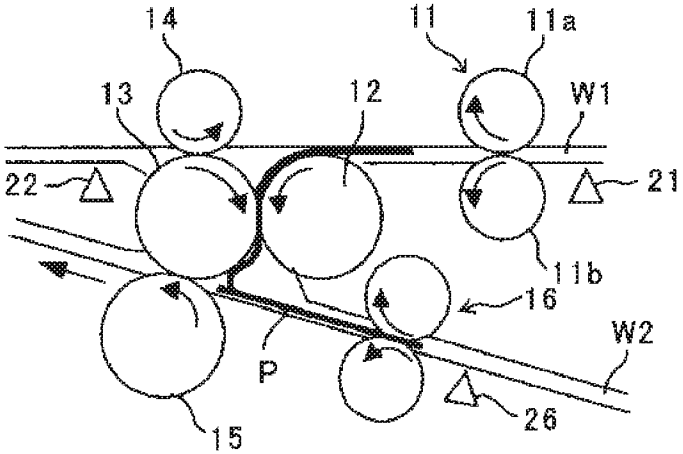
Figure 8H:
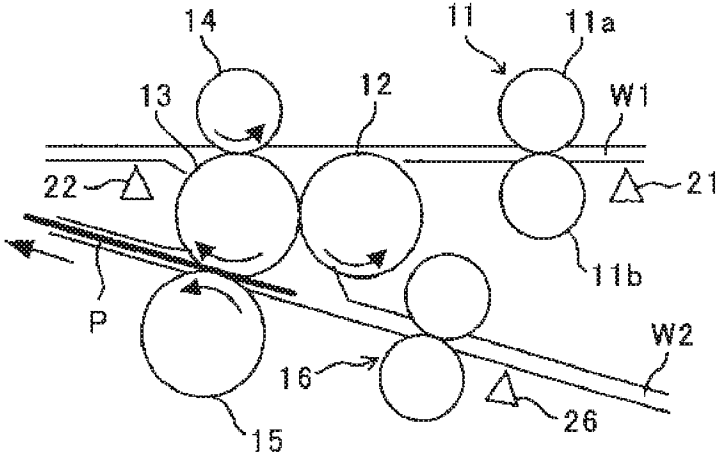
Figure 9A:
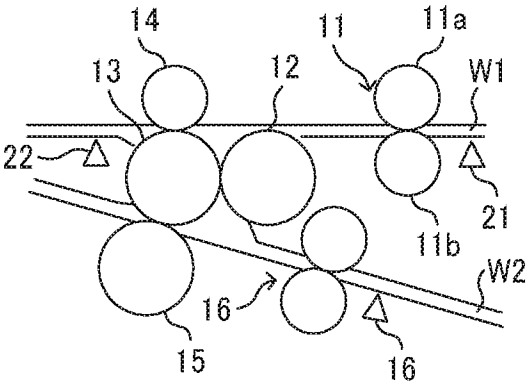
FIGS. 9A to 9I are explanatory diagrams illustrating a general operation when the folding apparatus performs two-fold processing.
Figure 9B:
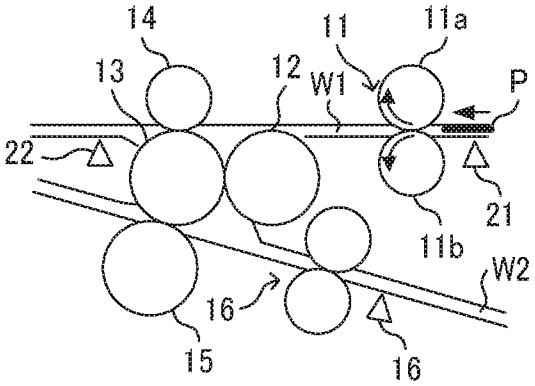
Figure 9C:
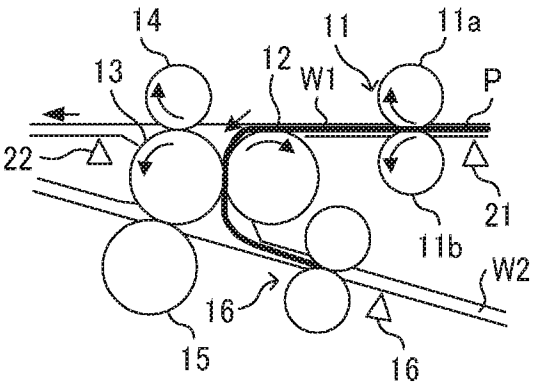
Figure 9D:
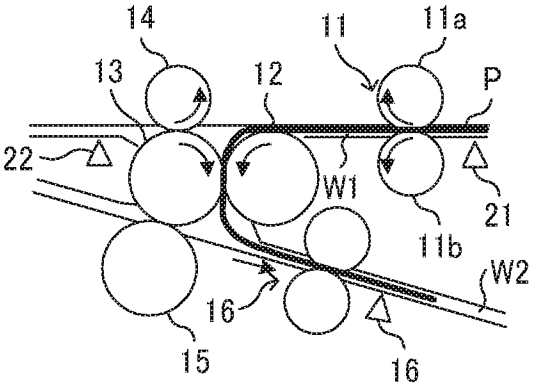
Figure 9E:
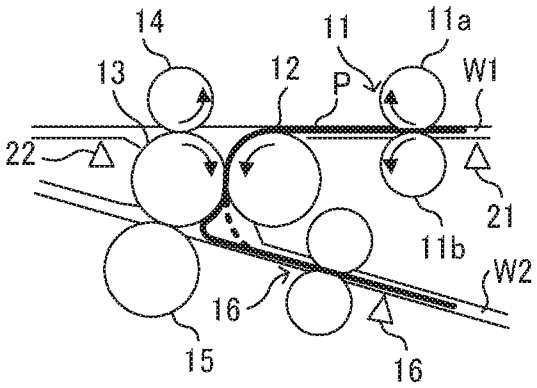
Figure 9F:
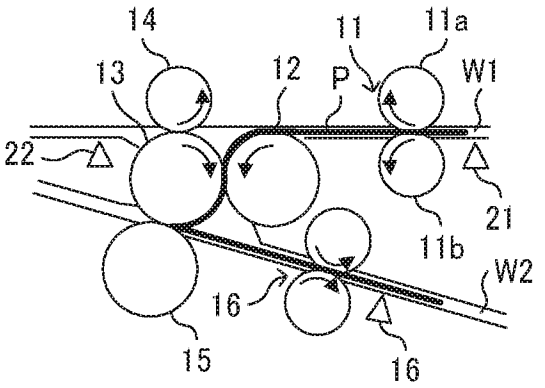
Figure 9G:
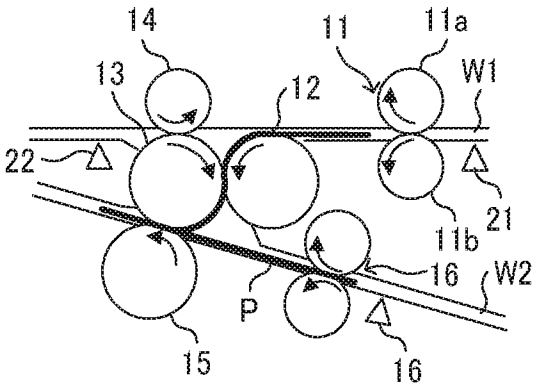
Figure 9H:
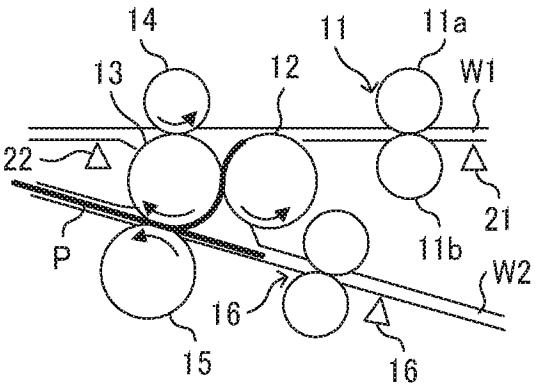
Figure 9I:
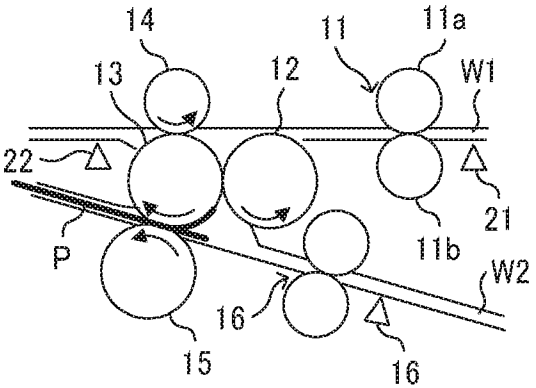

As illustrated in FIG. 6H, the second folded portion passes through the nip between the first forward and reverse rotation roller 13 and the second folding roller 15, and the first forward and reverse rotation roller 13 and the second folding roller 15 convey the second folded portion to the exist side of the bifurcation conveyance path W2. The first forward and reverse rotation roller 13 conveys the sheet P including the two folded portions described above to the post-processing apparatus 2 at the subsequent stage.

FIGS. 7A to 7H are explanatory diagrams illustrating a general operation when the folding apparatus 1 performs inner three-fold processing.

FIGS. 8A to 8H are explanatory diagrams illustrating a general operation when the folding apparatus 1 performs outer three-fold processing.

Although both the inner three-fold processing and the outer three-fold processing are similar to the above-described Z-folding processing, the protrusion amounts are different. Therefore, the timing of starting the reverse rotation of the first forward and reverse rotation roller 13 and the second forward and reverse rotation roller pair 16 is different between the Z-folding processing, the inner three-fold processing, and the outer three-fold processing.

FIGS. 9A to 9H are explanatory diagrams illustrating a general operation when the folding apparatus 1 performs the two-fold processing. Flow of operations in the two-fold processing is the same as the flow of the above-described Z-folding processing except that the above-described protrusion amount in the two-fold processing is different from the one in the Z-folding processing, and, in the two-fold processing, the leading edge of the sheet P conveyed on the through-conveyance path W1 does not enter the nip between the first forward and reverse rotation roller 13 and the pressing roller 14 and enters the nip between the first folding roller 12 and the first forward and reverse rotation roller 13. In the two-fold processing, the first conveyer corresponds to the first forward and reverse rotation roller 13 and the pressing roller 14, and the second conveyer corresponds to the second forward and reverse rotation roller pair 16. Or, the first folding roller 12 and the first forward and reverse roller 13 may perform the two-fold processing.

Next, the sheet overlay process is described. In the present embodiment, the folding apparatus 1 can overlay a plurality of sheets and folds the overlaid plurality of sheets.

Figure 11A:
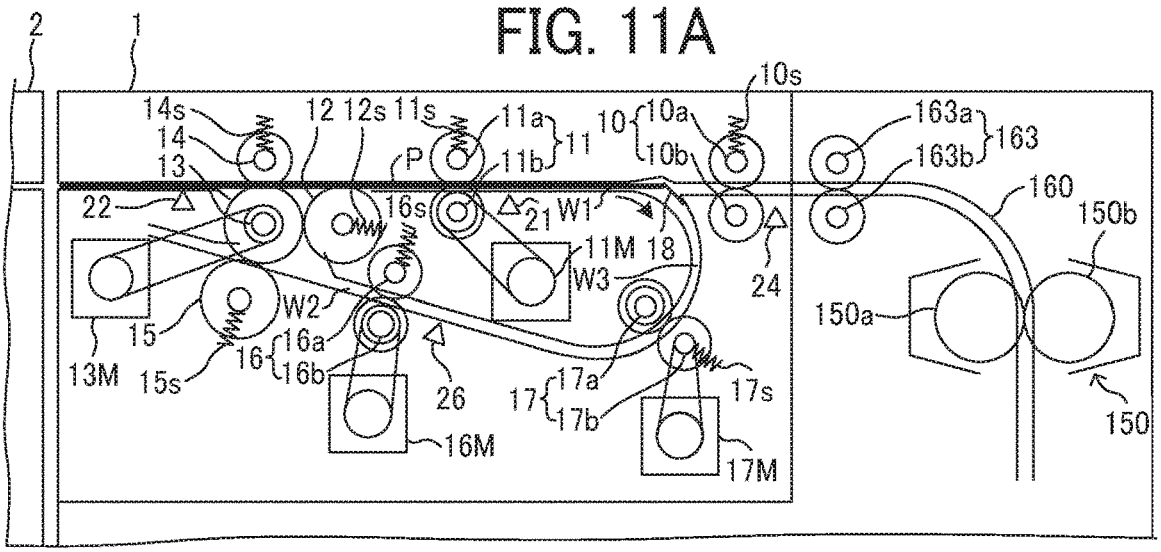
FIGS. 11A to 11C are explanatory diagrams illustrating operations of the sheet overlay process from a skew correction of the preceding sheet to when the preceding sheet is conveyed to a switchback conveyance path W3.
Figure 11B:
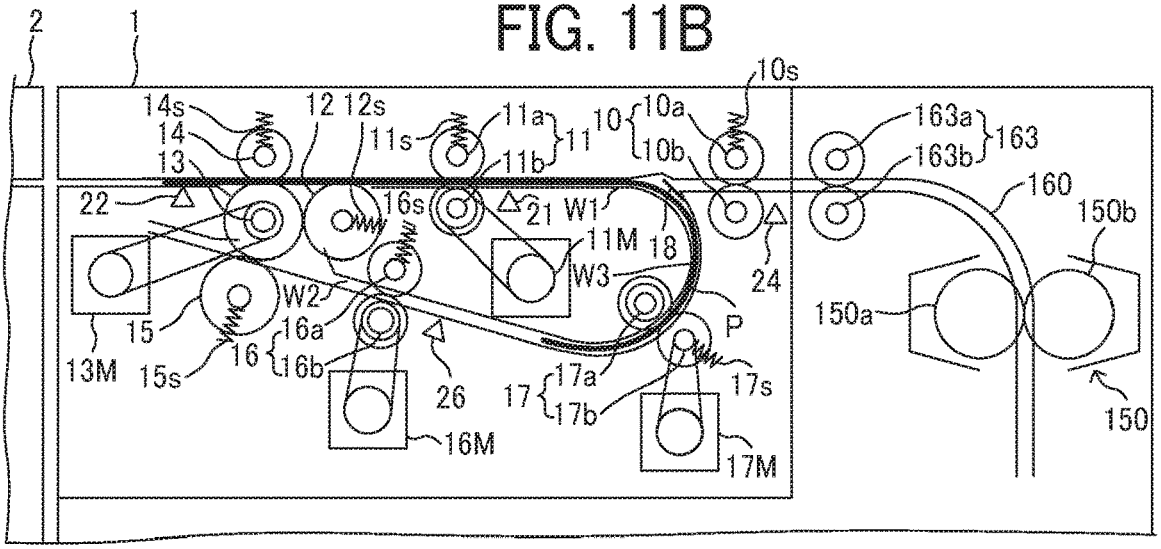
Figure 11C:
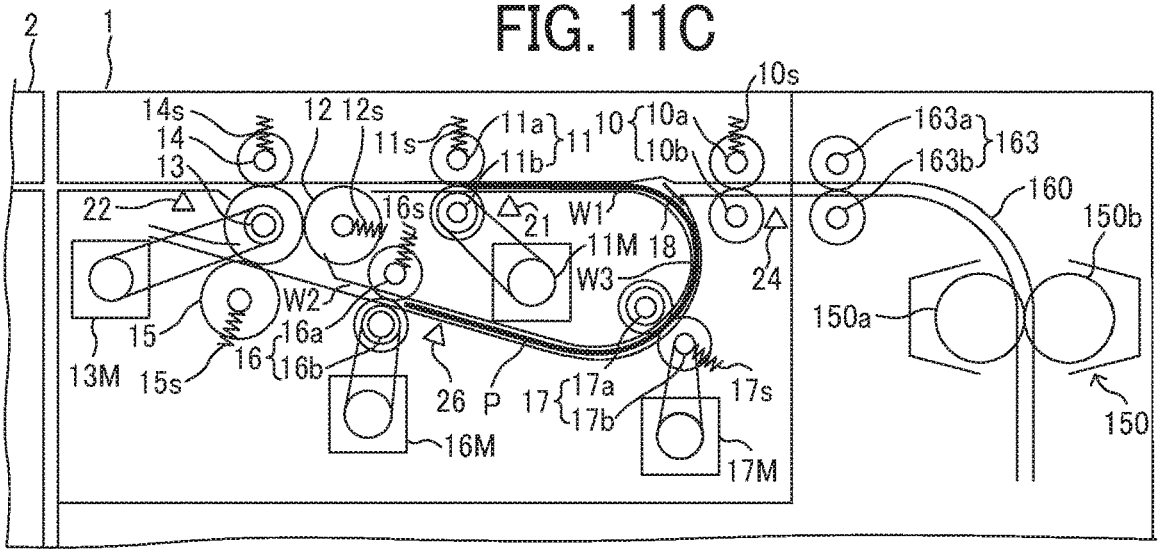
Figure 12A:
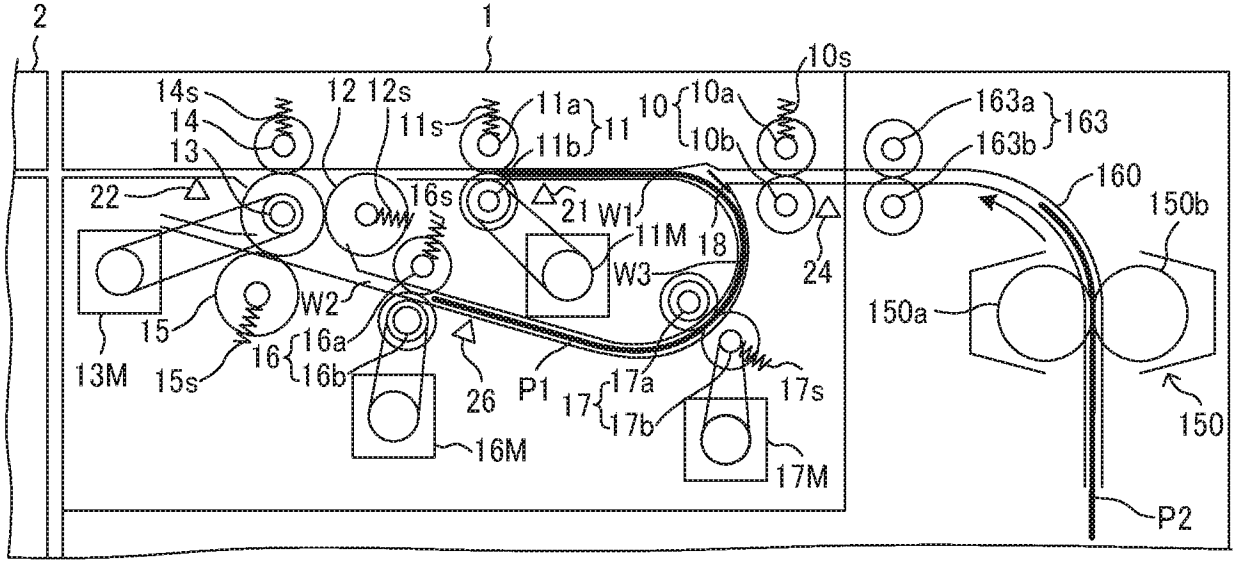
FIGS. 12A and 12B are explanatory diagrams illustrating operations of the sheet overlay process from when the preceding sheet is conveyed to the switchback conveyance path W3 to when a following sheet is overlaid to the preceding sheet.
Figure 12B:
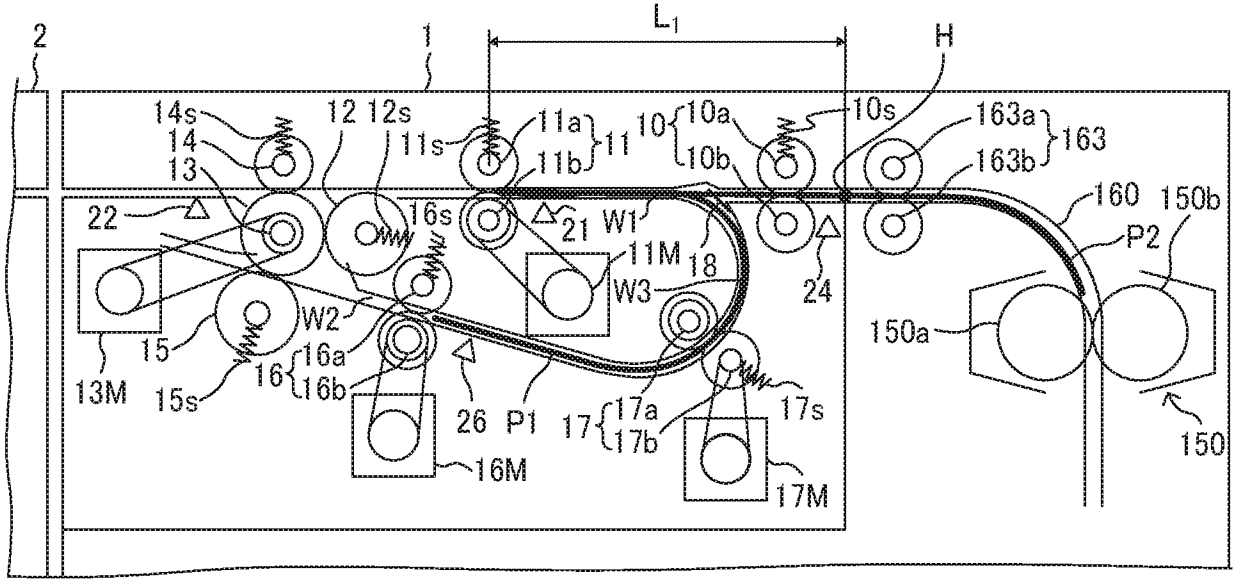
Figure 13:
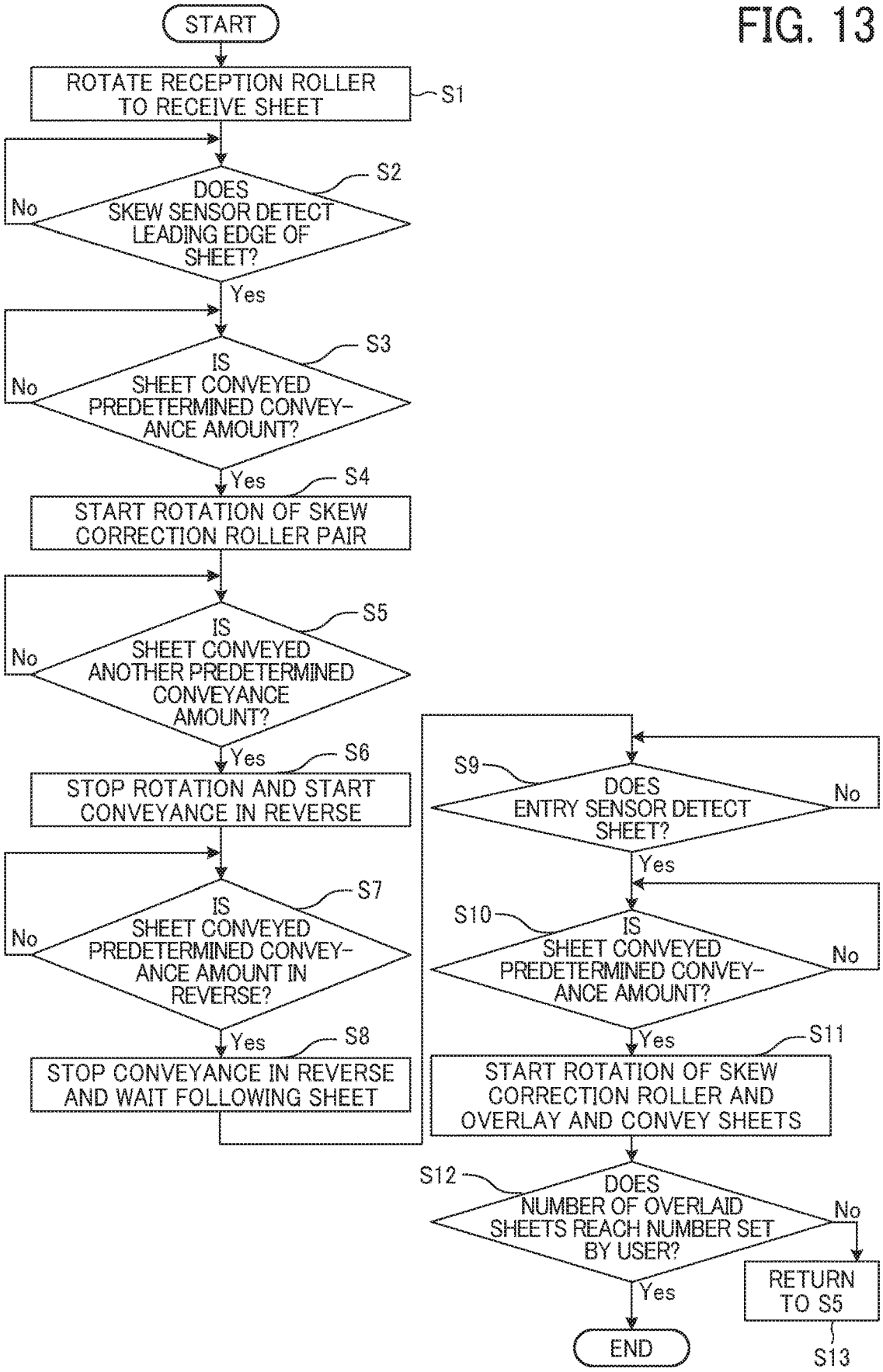
FIG. 13 is a flowchart of operations of the sheet overlay process.

FIGS. 10A, 10B, 11A to 11C, 12A, and 12B are explanatory diagrams illustrating a general operation when the folding apparatus 1 overlays a plurality of sheets. FIG. 13 is a flowchart of operations of the sheet overlay process.

Figure 10A:
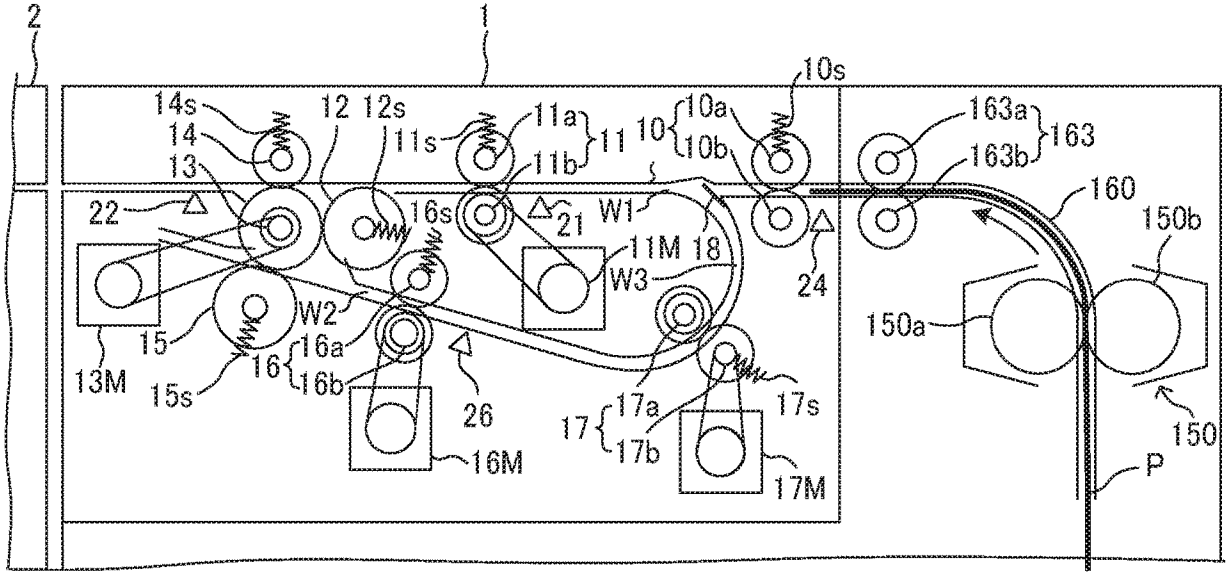
FIGS. 10A and 10B are explanatory diagrams illustrating operations of a sheet overlay process by when a skew correction roller pair corrects a skew of a preceding sheet.
Figure 10B:
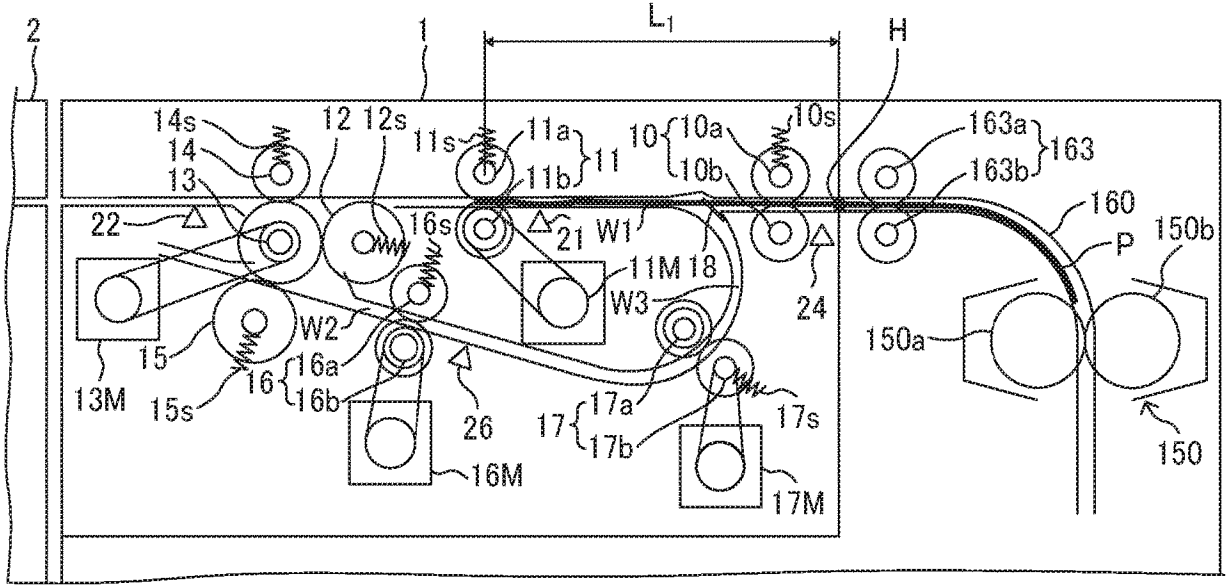

FIGS. 10A and 10B illustrate operations when a skew correction roller pair corrects a skew of a preceding sheet. FIGS. 11A to 11C illustrate operations when the preceding sheet is conveyed to the switchback conveyance path W3, and FIGS. 12A and 12B illustrate operations when the following sheet is overlaid to the preceding sheet.

As illustrated in FIG. 10A, the entry roller pair 10 of the folding apparatus 1 receives the sheet P from an output roller pair 163 in the image forming apparatus and conveys the sheet (step S1 in FIG. 13). The sheet P conveyed by the conveyance force applied from the entry roller pair 10 elastically deforms the film 18 in the counterclockwise direction and passes along the deformed film 18. Then, as illustrated in FIG. 10B, the leading edge of the sheet P contacts the skew correction roller pair 11, and the skew of the sheet P is corrected.

In the present embodiment, as illustrated in FIG. 10B, a sheet conveyance length L1 from an entry portion H to which the sheet P is conveyed in the folding apparatus 1 to the nip between the skew correction roller pair 11 is smaller than the maximum size of the sheet in the sheet conveyance direction that can process in the folding apparatus, which makes the folding apparatus smaller. In the present embodiment, the above-described L1 is shorter than a longer length of A4 size. Since the above-described L1 is shorter than the length of the sheet in the sheet conveyance direction, the trailing edge of the sheet P remains in the image forming apparatus when the leading edge of the sheet P contacts the skew correction roller pair 11.

The skew sensor 21 detects the leading edge of the sheet (Yes in step S2 of FIG. 13), the entry roller pair 10 conveys the sheet P by a predetermined conveyance amount (Yes in step S3 of FIG. 13), and the controller rotates the skew correction roller pair 11 in the predetermined direction to start sheet conveyance.

Specifically, when the skew sensor 21 detects the leading edge of the sheet, the controller starts time measurement and rotates the skew correction roller pair 11 in the predetermined direction at a predetermined time. The predetermined time is the time from when the skew sensor 21 detects the leading edge of the sheet to when the leading edge of the sheet contacts the skew correction roller pair, and the sheet P bends a predetermined amount to complete the skew correction.

Next, as illustrated in FIG. 11A, the sheet is conveyed by a predetermined conveyance amount when the trailing edge of the sheet passes through the fork between the through-conveyance path W1 and the switchback conveyance path W3 (Yes in step S6 of FIG. 13), and the controller stops rotation of the skew correction roller pair and the second conveyer. When the trailing edge of the sheet passes through the fork between the through-conveyance path W1 and the switchback conveyance path W3, the film 18 returns to the original shape. In the present embodiment, the predetermined conveyance amount is a conveyance amount from when the skew correction roller pair 11 starts sheet conveyance to when the trailing edge of the sheet passes through the fork. However, the predetermined conveyance amount may be a conveyance amount from when the entry sensor 24 detects the trailing edge of the sheet to when the trailing edge of the sheet passes through the fork.

Next, the skew motor 11M, the first motor 13M, and the switchback motor 17M rotates in reverse to convey the sheet in the reverse direction, that is, convey the sheet in the opposite direction to the predetermined direction, which is called reverse conveyance, in step S6 of FIG. 13.

When the sheet P is conveyed in the reverse direction, that is, the opposite direction to the predetermined direction, the film 18 guides the trailing edge of the sheet in the regular direction, that is, the predetermined direction to convey the sheet to the switchback conveyance path W3 as illustrated in FIG. 11B. Next, when the sheet P is conveyed by a predetermined conveyance amount in the reverse direction (Yes in step S7), the controller stops reverse rotation of the skew motor 11M, the first motor 13M, and the switchback motor 17M to stop the reverse conveyance of the sheet in step S8 of FIG. 13. The predetermined conveyance amount in the reverse direction, that is, the opposite direction to the predetermined direction is a conveyance amount from the start of the conveyance of the sheet in the reverse direction (the conveyance of the sheet in the opposite direction to the predetermined direction) to when the leading edge of the sheet in the predetermined direction is positioned in front of the skew correction roller as illustrated in FIG. 11C. The predetermined conveyance amount in the reverse direction, that is, the opposite direction to the predetermined direction may be a conveyance amount from when the sheet detector 26 detects the trailing edge of the sheet in the regular conveyance that is the conveyance in the predetermined direction to the switchback conveyance path W3 to when sheet is positioned as illustrated in FIG. 11C.

Next, the switchback motor 17M rotates forward by a predetermined conveyance amount, and the leading edge of the sheet P contacts the skew correction roller pair to perform the skew correction.

Next, as illustrated in FIG. 12A, the following sheet P2 is conveyed from the image forming apparatus 3. At this time, since the preceding sheet P1 waiting before the skew correction roller pair is on the skew sensor 21, the skew sensor 21 cannot detect the leading edge of the following sheet P2. Therefore, in skew correction of the following sheets, the sheet is conveyed by a predetermined amount after the entry sensor 24 detects the leading edge of the following sheet P2 (Yes in S9, Yes in S10). FIG. 12B illustrates a state in which the following sheet P2 is conveyed by the predetermined amount after the entry sensor 24 detects the leading edge of the following sheet P2, and the leading edge of the following sheet P2 contacts the skew correction roller pair 11 to correct the skew of the following sheet P2. That is, the predetermined amount is a sheet conveyance amount from when the entry sensor 24 detects the leading edge of the following sheet P2 to when the leading edge of the following sheet P2 contacts the skew correction roller pair 11 to correct the skew of the following sheet P2.

In the present embodiment, as described above, since the sheet conveyance length L1 from the entry portion H to the skew correction roller pair 11 is shorter than the length of the sheet in the sheet conveyance direction, as illustrated in FIG. 12B, the trailing edge of the preceding sheet P1 remains in the image forming apparatus 3 in the overlay process that overlays the following sheet P2 on the preceding sheet P1.

As described above, after the skew correction of the following sheet P2 by the skew correction roller pair 11 and the overlay process that overlays the following sheet P2 on the preceding sheet P1, the skew correction roller pair 11 conveys the overlaid following sheet P2 and the preceding sheet P1 in step S11 of FIG. 13. When a number of sheets set by the user are overlaid (Yes in step S12), the overlay process ends. When the folding processing is performed on the overlaid sheets, the overlaid sheets are conveyed to the bifurcation conveyance path W2, and the folding processing is performed. On the other hand, when the overlaid sheets are processed by the post-processing apparatus, the overlaid sheets are delivered to the post-processing apparatus 2 through the through-conveyance path W1.

On the other hand, when a number of overlaid sheets is less than the number of sheets set by the user (No in step S12), the steps after step S5 are executed again.

In the present embodiment, as illustrated in FIG. 10B, the sheet conveyance length L1 from the entry portion H to the nip between the skew correction roller pair 11 is smaller than the length of the sheet in the sheet conveyance direction. This configuration reduces the size of the folding apparatus 1. In this configuration, during the skew correction by the skew correction roller pair 11, a trailing portion of the sheet remains in the image forming apparatus, and the output roller pair 163 conveys the trailing portion of the sheet. However, since controlling a start timing of conveyance by the skew correction roller pair enables performing desired skew correction, it is not necessary to control the output roller pair in the image forming apparatus. Therefore, it is possible to realize miniaturization of the apparatus by simple control.

In the present embodiment, the folding apparatus 1 includes the switchback conveyance path W3 to receive the preceding sheet P1 conveyed in the reverse direction. Therefore, the preceding sheet P1 conveyed in the reverse direction does not enter the image forming apparatus 3 though the sheet conveyance length L1 from the entry portion H to the nip between the skew correction roller pair 11 is smaller than the length of the sheet in the sheet conveyance direction.

In the present embodiment, the leading edge of the preceding sheet in the regular direction, that is, the predetermined direction is positioned before the skew correction roller pair 11 in switchback conveying, that is, conveying the sheet in the reverse direction. This provides certain advantages compared to a technique in which the preceding skew-corrected sheet by the skew correction roller pair 11 is conveyed in the regular direction, that is, the predetermined direction and looped one round, and the leading edge of the preceding sheet in the regular direction is positioned before the skew correction roller pair 11. When the preceding sheet is looped one round and returned before the skew correction roller pair 11, a large curvature of a loop formed by the preceding sheet prevents satisfactory conveyance, so it is necessary to reduce the curvature of the loop. As a result, the conveying path length of one round of the loop is somewhat longer than the length of the sheet in the conveyance direction. As a result, in the above-described technology, after the trailing edge of the sheet has passed through the skew correction roller pair 11, the preceding sheet is conveyed to some extent, and the leading edge of the preceding sheet is positioned before the skew correction roller pair 11.

When the sheet is sandwiched by the skew correction roller pair 11, the skew correction can be kept, but, after the trailing edge of the sheet passes through the skew correction roller pair 11, other conveyance roller pairs may affect and increase the skew of the sheet. As described above, since the technology in which the sheet is looped one round and returned to the skew correction roller pair conveys the sheet to some extent after the sheet passes through the skew correction roller pair, the amount of the skew may increase while the sheet is conveyed to some extent.

The preceding sheet is bent and contacts the skew correction roller pair 11 to correct the skew, but too much bending amount of the sheet for the skew correction may cause the preceding sheet to block the conveyance path and obstruct conveyance of the following sheet, which results in conveyance failure. Therefore, the bending amount of the sheet cannot be increased, and the amount of skew that can be corrected is limited. Therefore, the technology in which the sheet is looped one round and returned to the skew correction roller pair may increase the amount of skew, does not perfectly correct the skew, and may leave the skew.

In the present embodiment, since switchback conveying returns the preceding sheet before the skew correction roller pair 11, the preceding sheet returns before the skew correction roller immediately after the leading edge of the preceding sheet in the regular conveyance passes through the skew correction roller pair 11. Since the preceding sheet is hardly conveyed after passing through the skew correction roller pair 11, and stopped the conveyance, the preceding sheet does not greatly skew. Therefore, skew correction after the preceding sheet returns before the skew correction roller pair 11 can correct the skew enough and satisfactorily overlay the following sheet on the preceding sheet.

Preferably, the timing of stopping the sheet when the switchback conveying returns the preceding sheet before the skew correction roller pair 11 is immediately after the leading edge of the preceding sheet in the regular conveyance that is the conveyance in the predetermined direction passes through the skew correction roller pair 11, and the reverse conveyance that is conveyance in the opposite direction to the predetermined direction preferably stops before the distance from the skew correction roller pair 11 to the leading edge of the preceding sheet in the regular direction becomes at least 5 mm.

When a plurality of sheets is overlaid and folded, the positions of the folded portions may be different for each sheet. To align the positions of the folded portions, the preceding sheet may be stopped in the switchback conveying when the leading edge of the preceding sheet in the regular direction, that is, the predetermined direction is sandwiched by the skew correction roller pair 11, which forms a predetermined gap in the sheet conveyance direction between the preceding sheet and the following sheet overlaid the preceding sheet. Since the preceding sheet is stopped in the switchback conveying when the leading edge of the preceding sheet in the regular direction, that is, the predetermined direction is sandwiched by the skew correction roller pair 11 and does not separate from the skew correction roller pair 11, the skew of the preceding sheet does not occur in this switchback conveying. This can improve the productivity and shorten time for control in the overlay process compared to the over lay process in which the preceding sheet is conveyed to form the predetermined gap between the preceding sheet and the following sheet overlaid the preceding sheet after the preceding sheet contacts the skew correction roller pair to correct the skew and the leading edge of the preceding sheet is sandwiched.

First Variation

Next, a description is given of a folding apparatus 1 according to variations.

Figure 14:
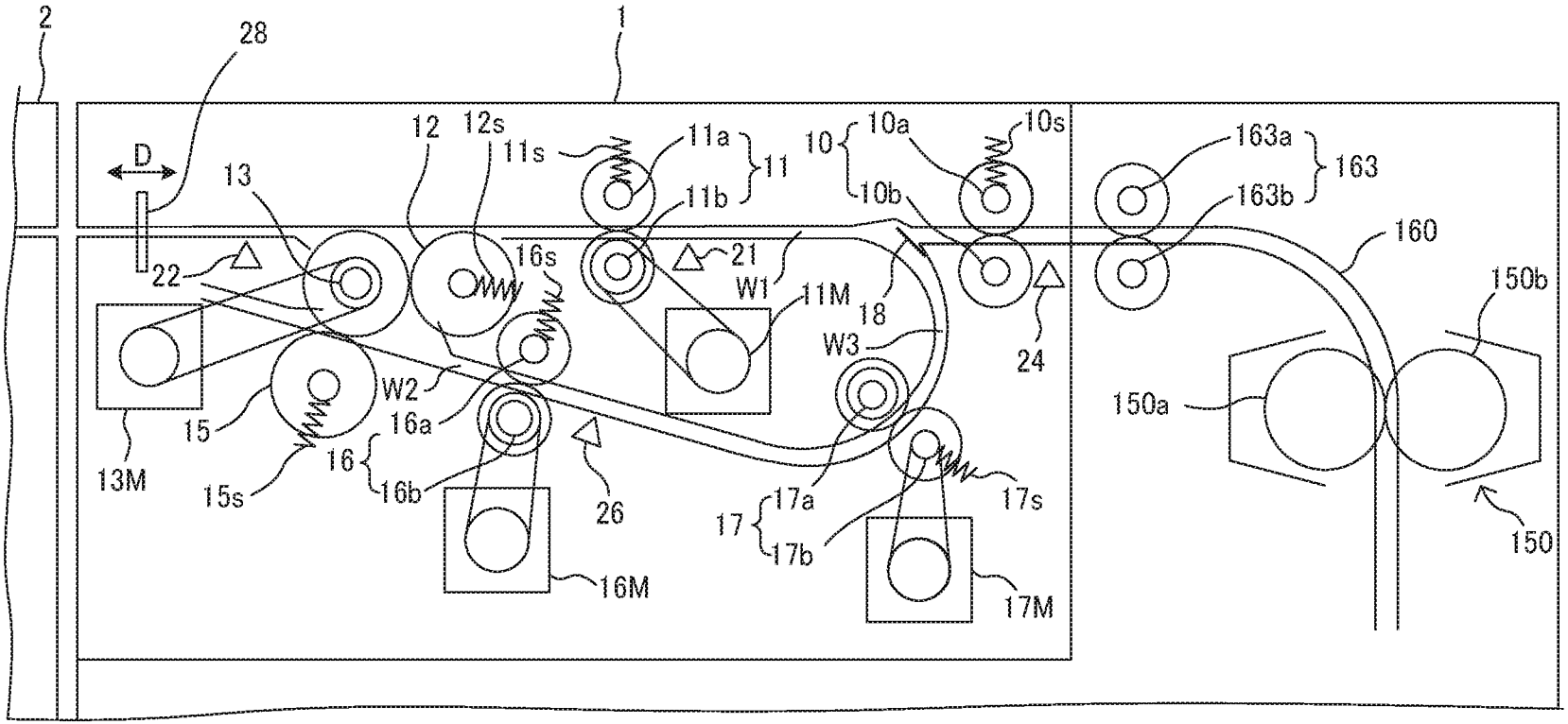
FIG. 14 is a schematic configuration diagram of a folding apparatus according to a first variation.

FIG. 14 is a schematic configuration diagram of a folding apparatus according to a first variation.

As illustrated in FIG. 14, the first variation includes a stopper 28 instead of the second conveyer. The stopper 28 is configured to be retractable from the through-conveyance path W1 and movable in the sheet conveyance direction as indicated by an arrow D in FIG. 14. When the sheet is conveyed to the post-processing apparatus without the folding processing, the stopper 28 is retracted from the through-conveyance path W1. This enables the sheet to convey to the post-processing apparatus without being stopped by the stopper 28.

On the other hand, when the folding processing is performed, the stopper 28 is positioned on the through-conveyance path W1 and moved to a position corresponding to a type of the folding processing in a direction of an arrow D in the FIG. 14.

Figure 15:
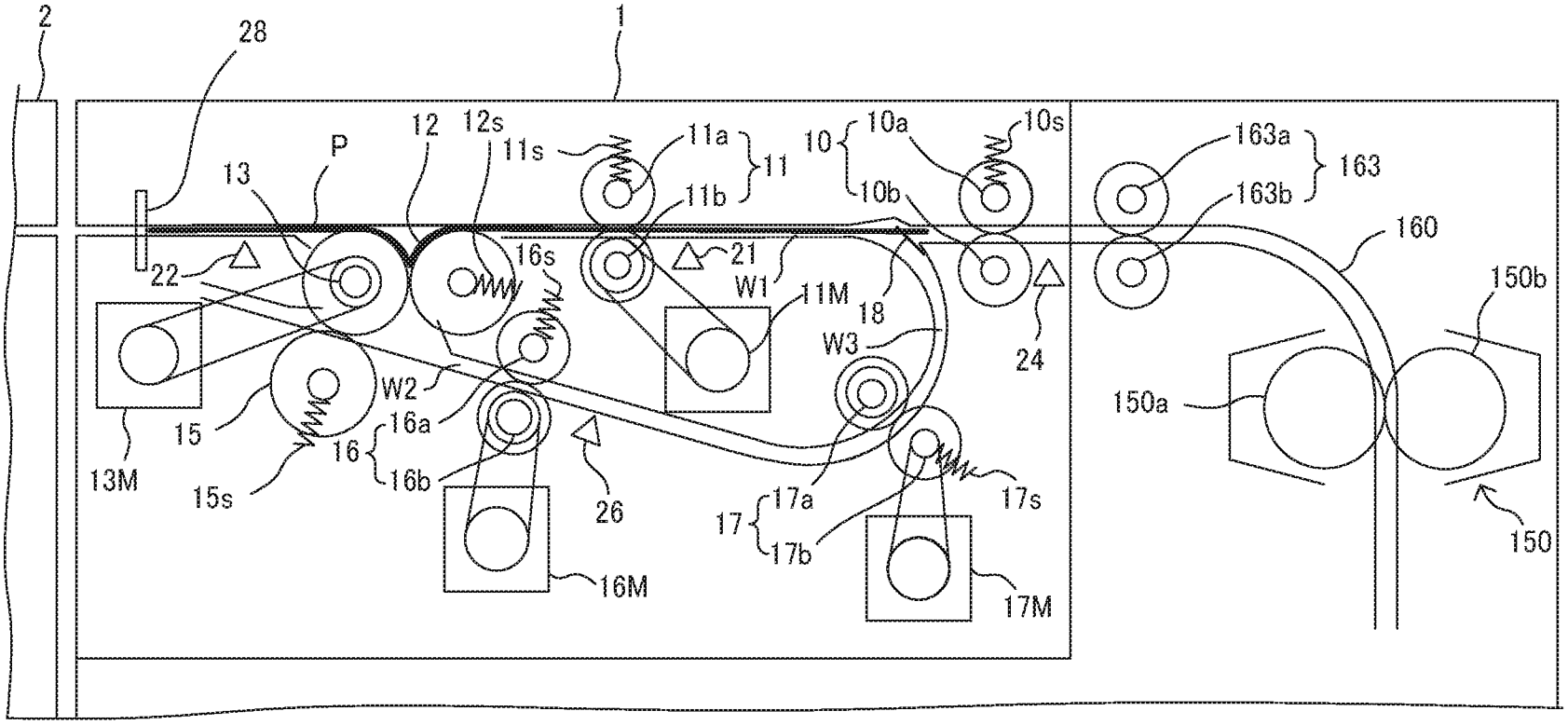
FIG. 15 is an explanatory diagram illustrating folding processes in the folding apparatus according to the first variation.

FIG. 15 is an explanatory diagram illustrating folding processes in the folding apparatus 1 according to the first variation.

As illustrated in FIG. 15, the skew correction roller pair 11 conveys the sheet P, leads the leading edge of the sheet P to contact the stopper 28, and forms bend of the sheet P between the skew correction roller pair 11 and the stopper 28. The bend of the sheet, that is, a folded back portion, enters the nip between the first folding roller 12 and the first forward and reverse rotation roller 13, and the folded portion is formed at the folded back portion.

In the configuration of the above embodiment, after the first forward and reverse rotation roller 13 rotates forward and conveys the sheet by a predetermined amount, the first forward and reverse rotation roller 13 stops conveyance of the sheet and rotates in reverse to bend the sheet, and the bend of the sheet enters the nip between the first folding roller 12 and the first forward and reverse rotation roller 13. However, in the first variation, the first forward and reverse rotation roller 13 does not need to rotate forward and convey the sheet, and it is enough for the first forward and reverse rotation roller 13 to rotate in reverse at a predetermined timing. Since the first forward and reverse rotation roller 13 does not need to stop the conveyance of the sheet to switch from forward rotation drive to reverse rotation drive, the first variation can shorten the folding processing time and improve the productivity.

Second Variation

Figure 16:
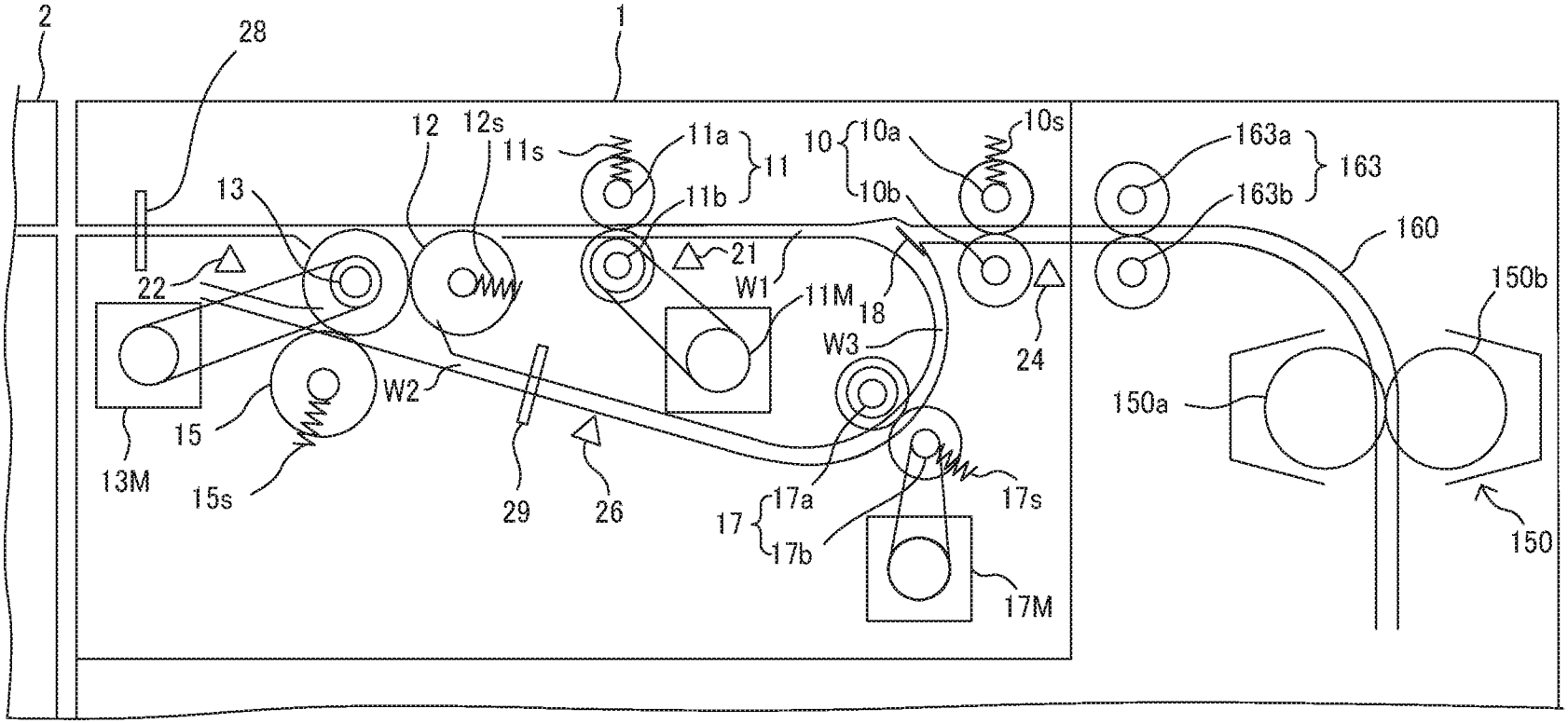
FIG. 16 is a schematic configuration diagram of a folding processing apparatus according to a second variation.

FIG. 16 is a schematic configuration diagram of a folding apparatus according to a second variation.

The folding apparatus of the second variation includes a second stopper 29 instead of the second forward and reverse rotation roller pair 16 of the folding apparatus of the first variation to further improve the productivity. Unlike the stopper 28 described above, the second stopper 29 cannot retract from the conveyance path and can move only in the sheet conveyance direction. When the folding processing is performed, the second stopper 29 is moved in the sheet conveyance direction to position the second stopper 29 at the position corresponding to the type of the folding processing.

Figure 17A:
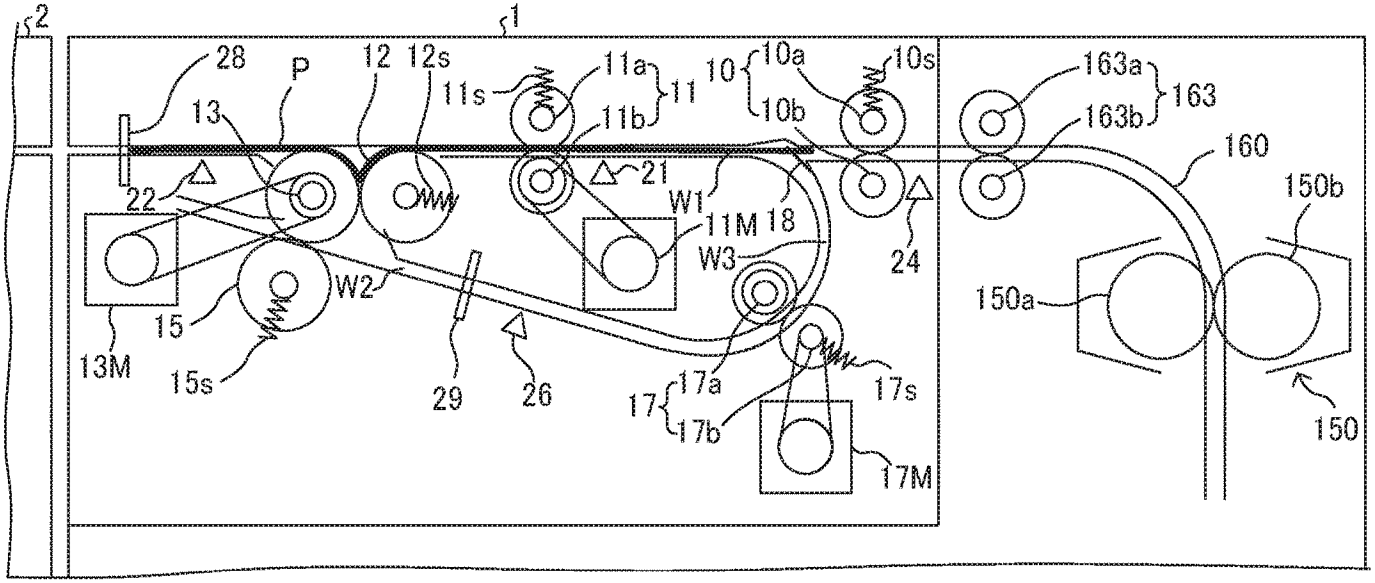
FIGS. 17A and 17B are explanatory diagrams illustrating folding processes in the folding apparatus according to the second variation.
Figure 17B:
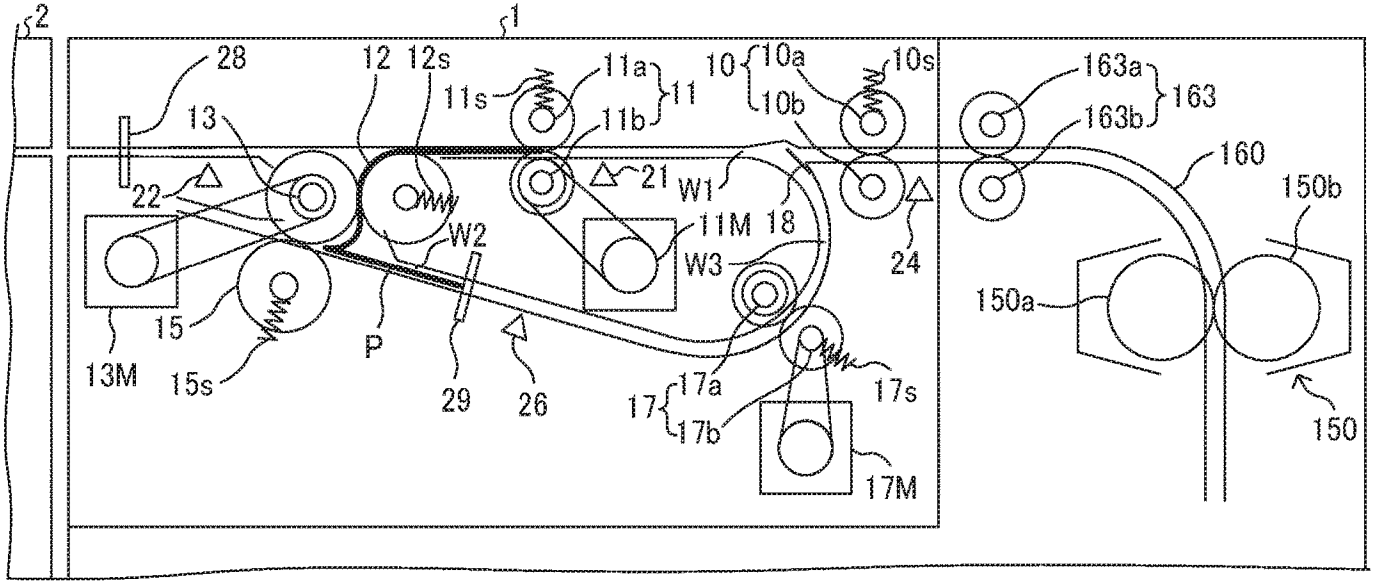

FIGS. 17A and 17B are explanatory diagrams illustrating the folding processing performed by the folding apparatus according to the second variation.

As illustrated in FIG. 17A, the skew correction roller pair 11 conveys the sheet P, leads the leading edge of the sheet P to contact the stopper 28, and forms bend of the sheet P between the skew correction roller pair 11 and the stopper 28. The bend of the sheet, that is, a folded back portion, enters the nip between the first folding roller 12 and the first forward and reverse rotation roller 13, and the folded portion is formed at the folded back portion.

The first folded portion of the sheet P passes through the nip between the first folding roller 12 and the first forward and reverse rotation roller 13, enters the bifurcation conveyance path W2, is conveyed to the second stopper 29 on the bifurcation conveyance path W2, and, as illustrated in FIG. 17B, contacts the second stopper 29. This operation forms a bend of the sheet between the first forward and reverse rotation roller 13 and the second forward and reverse rotation roller pair 16. The above-described bend of the sheet, that is, a folded back portion, enters the nip between the first forward and reverse rotation roller 13 and the second folding roller 15, and the second folded portion is formed at the folded back portion.

In the present embodiment, after the second forward and reverse rotation roller pair 16 rotates forward and conveys the sheet by a predetermined amount, the second forward and reverse rotation roller pair 16 stops conveyance of the sheet and rotates in reverse to bend the sheet, and the bend of the sheet enters the nip between the second folding roller 15 and the first forward and reverse rotation roller 13. However, the second variation that includes the stopper instead of the second forward and reverse rotation roller pair 16 can bend the sheet and lead the bend of the sheet to enter the nip between the second folding roller 15 and the first forward and reverse rotation roller 13 without stopping the conveyance of the sheet. This shortens the folding processing time and improves productivity.

Third Variation

Figure 18:
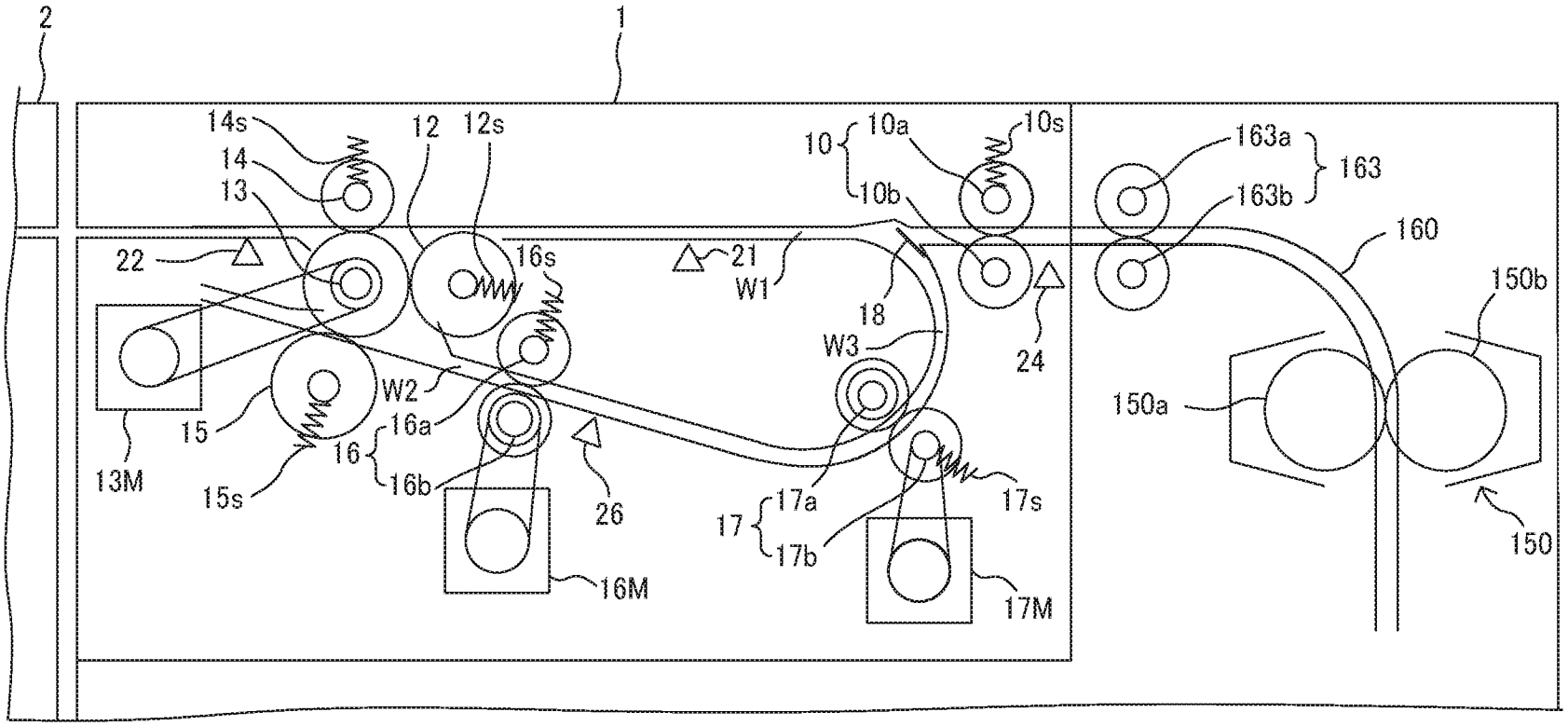
FIG. 18 is a schematic configuration diagram of a folding apparatus according to a third variation.

FIG. 18 is a schematic configuration diagram of a folding apparatus according to a third variation.

The folding apparatus according to the third variation illustrated in FIG. 18 does not include the skew correction roller pair. Instead, the second conveyer configured by the first forward and reverse rotation roller 13 and the pressing roller 14 perform the skew correction.

Figure 19A:
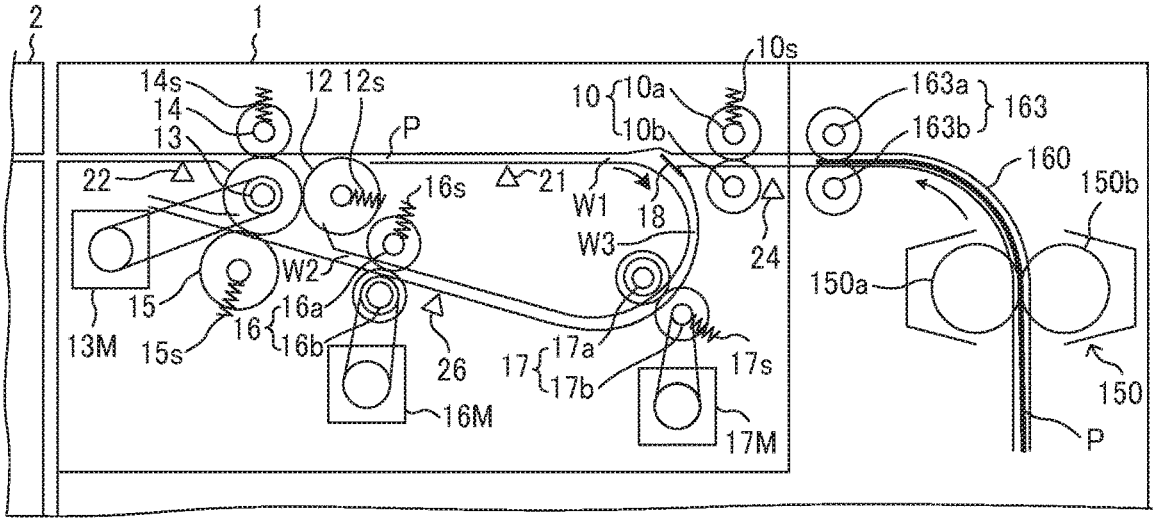
FIGS. 19A to 19C are explanatory diagrams illustrating operations of overlay and folding processing of the folding apparatus according to the third variation while the preceding sheet is corrected the skew by a second conveyer and conveyed to the switchback conveyance path.
Figure 19B:
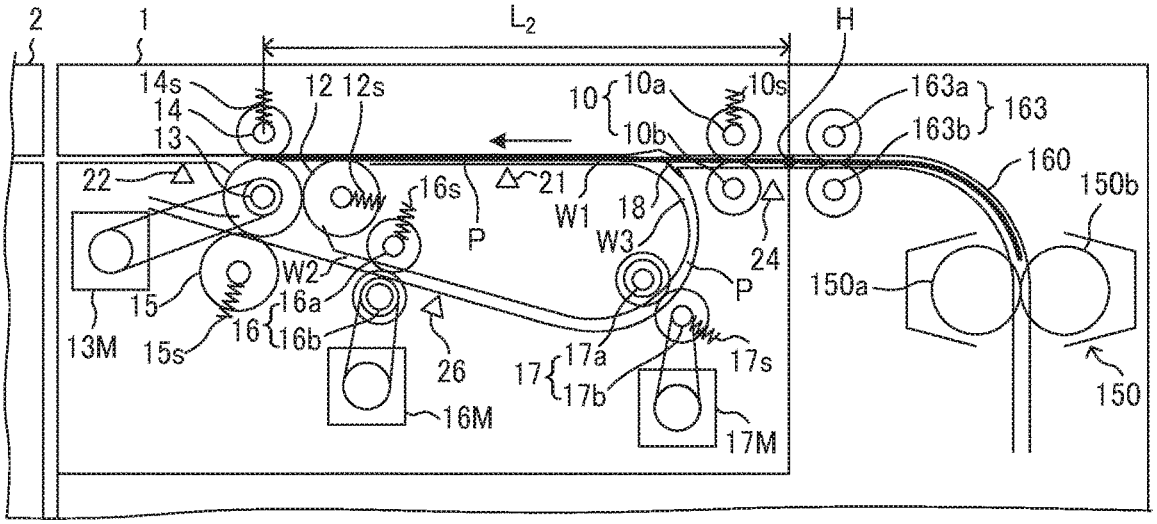
Figure 19C:
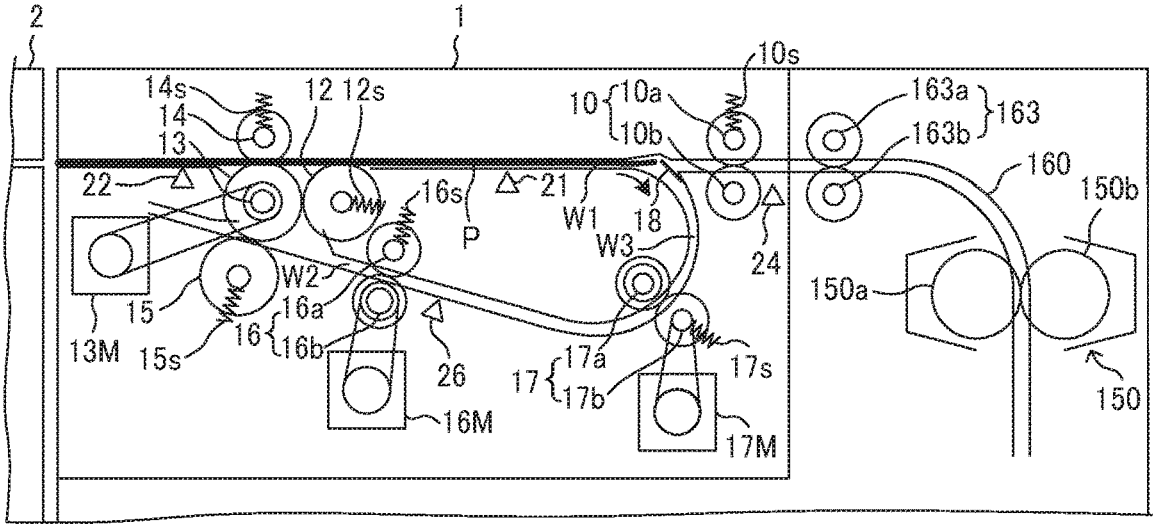
Figure 20A:
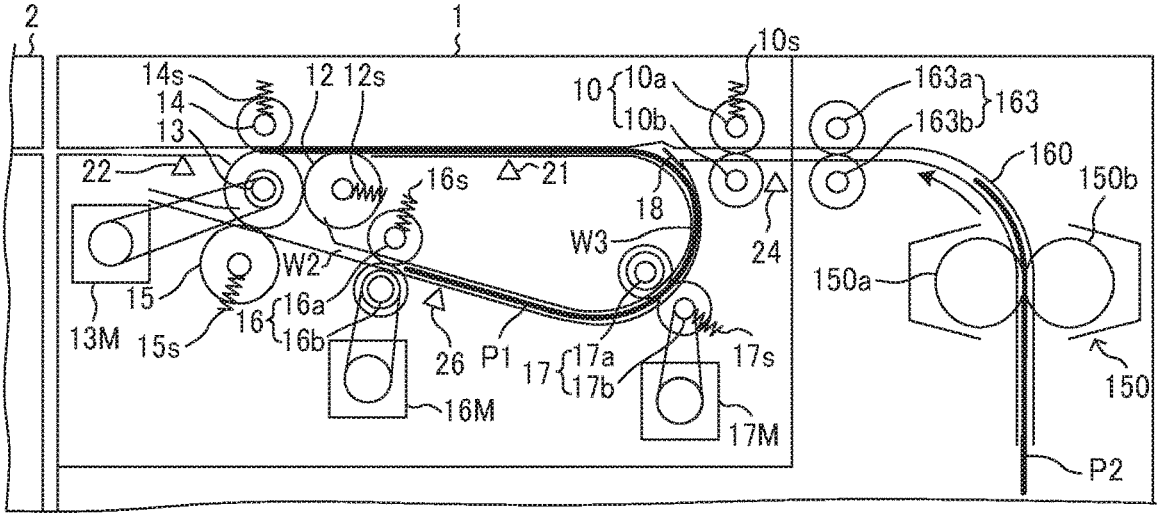
FIGS. 20A to 20C are explanatory diagrams illustrating operations of the overlay and folding processing of the folding apparatus according to the third variation from when the preceding sheet is conveyed to the switchback conveyance path to when a first folded portion is formed on an overlaid sheet bundle.
Figure 20B:
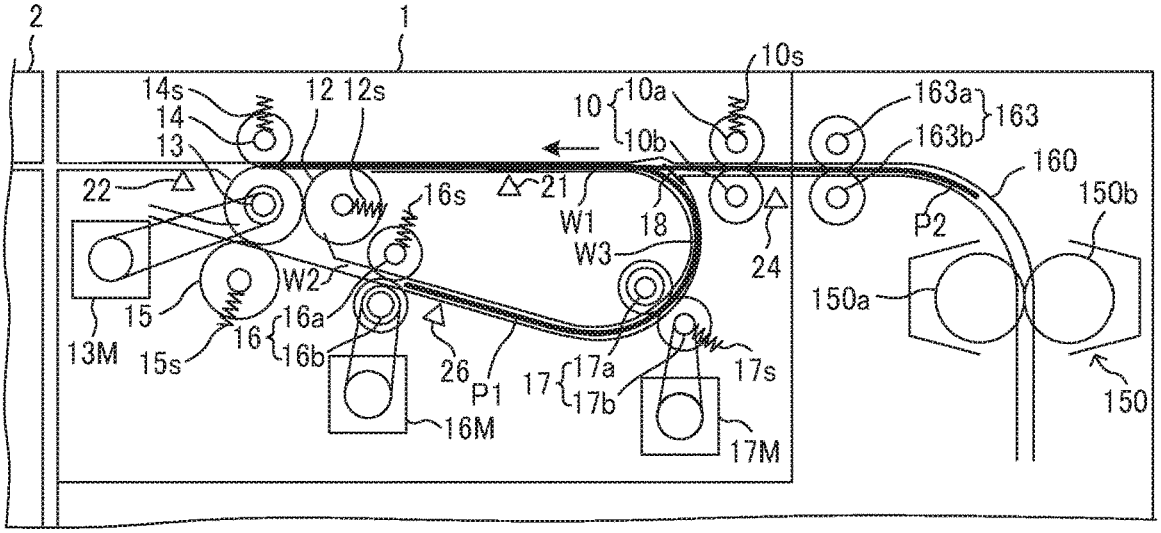
Figure 20C:
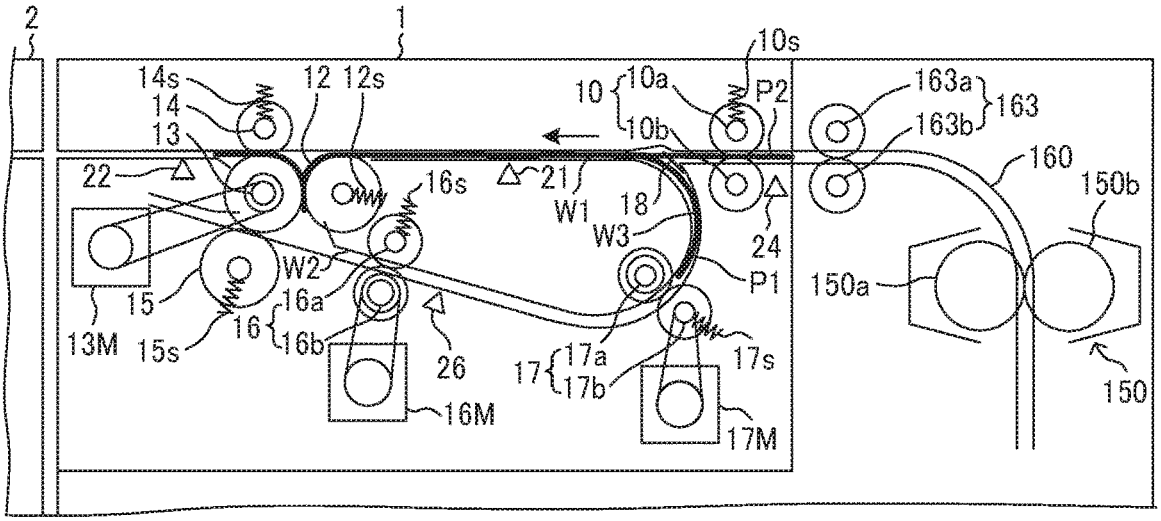
Figure 21A:
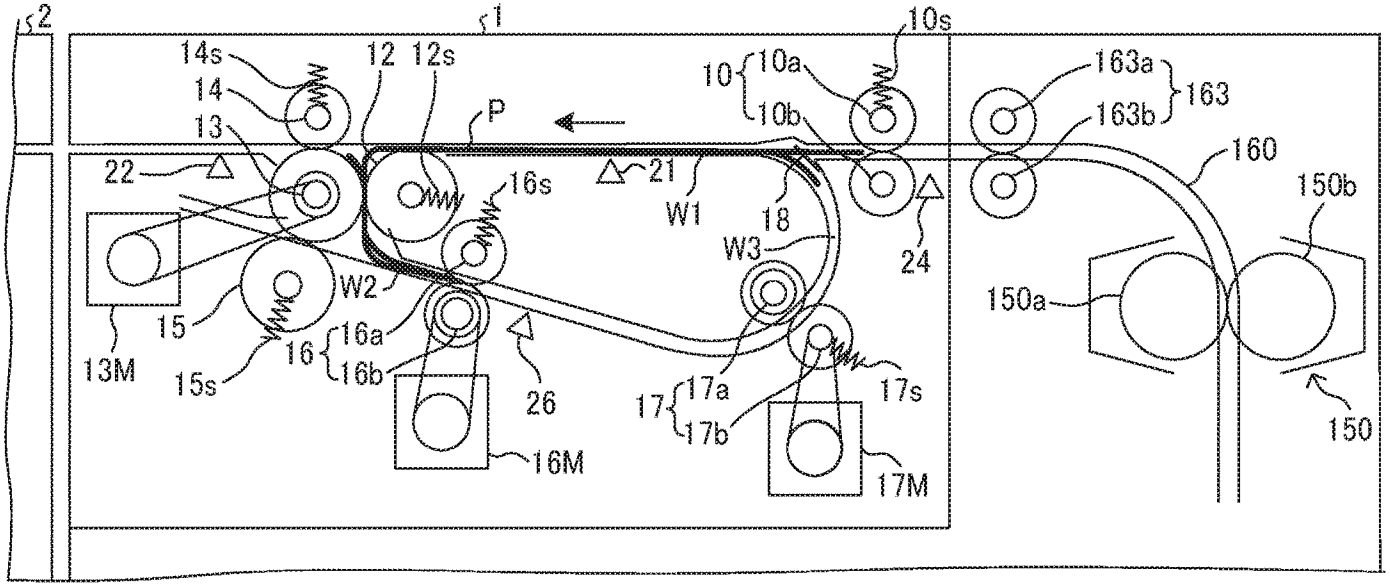
FIGS. 21A and 21B are explanatory diagrams illustrating an example of a second folded portion in a sheet bundle formed by operations of the overlay and folding processing of the folding apparatus according to the third variation.
Figure 21B:
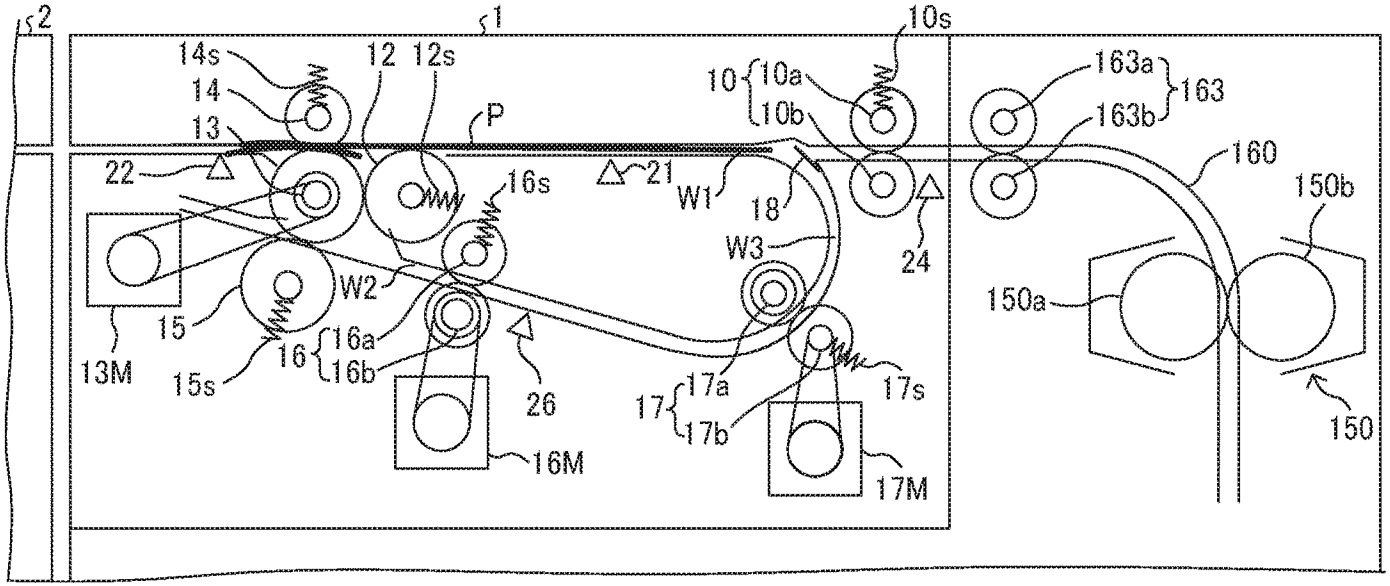
Figure 22A:
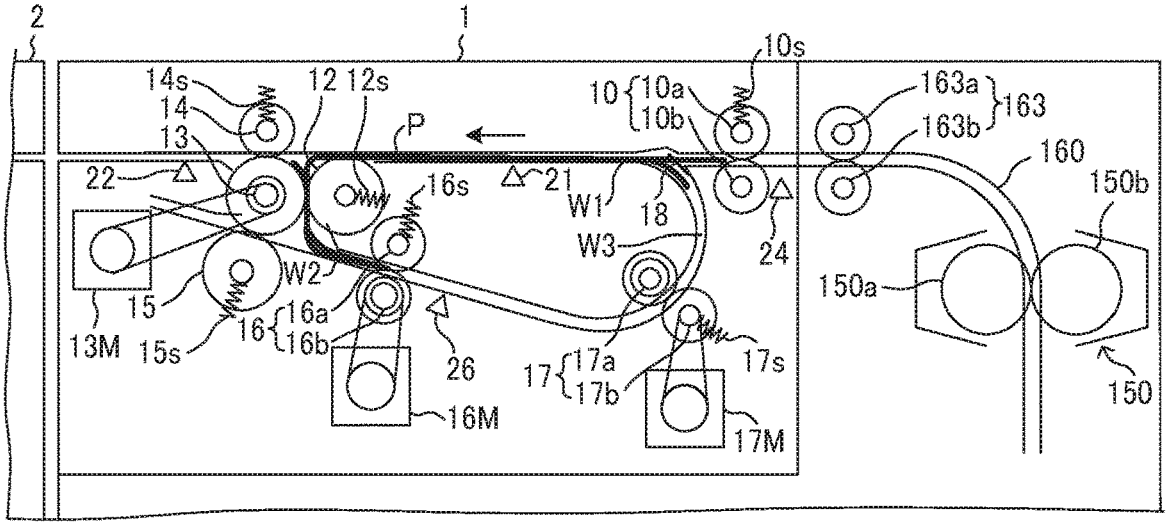
FIGS. 22A to 22C are explanatory diagrams illustrating another example of a second folded portion in a sheet bundle formed by operations of the overlay and folding processing of the folding apparatus according to the third variation.
Figure 22B:
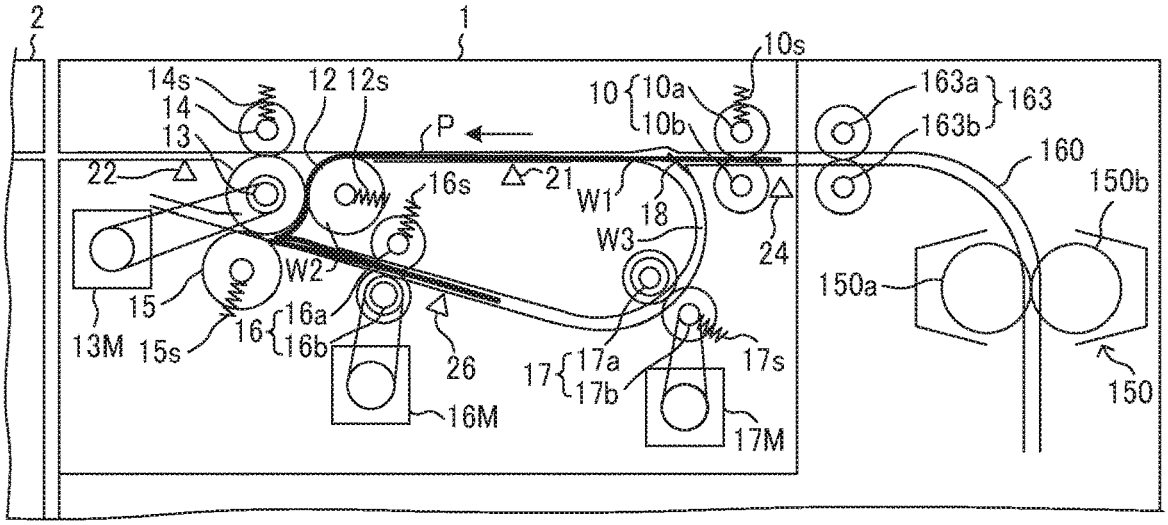
Figure 22C:
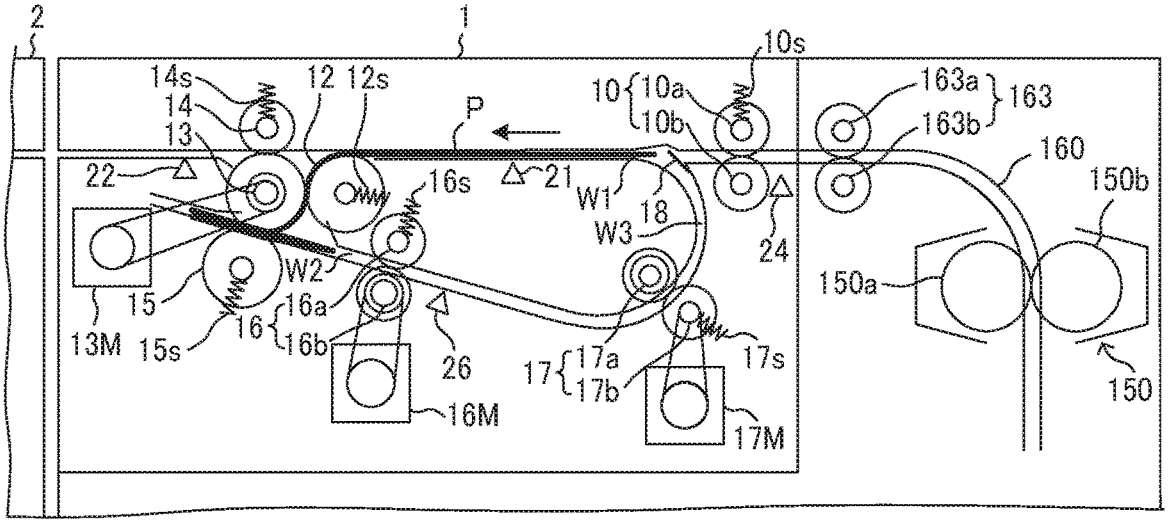

FIGS. 19A to 19C, 20A to 20C, 21A, 21B, and 22A to 22C are explanatory diagrams illustrating operations of an overlay and folding processing in the folding apparatus according to the third variation. FIGS. 19A to 19C are explanatory diagrams illustrating operations while the preceding sheet is corrected the skew by the second conveyer and conveyed to the switchback conveyance path W3, and FIGS. 20A to 20C are explanatory diagrams illustrating operations from when the preceding sheet is conveyed to the switchback conveyance path W3 to when the first folded portion is formed on an overlaid sheet bundle. FIGS. 21A and 21B are explanatory diagrams illustrating an example of forming a second folded portion in the sheet bundle, and FIGS. 22A to 22C are explanatory diagrams illustrating another example of forming the second folded portion in the sheet bundle.

As illustrated in FIGS. 19A and 19B, the leading edge of the sheet ejected from the image forming apparatus 3 contacts the second conveyer configured by the first forward and reverse rotation roller 13 and the pressing roller 14 to correct the skew. In the third variation, a conveyance path length L2 from the entry portion H to the second conveyer is smaller than the maximum size of the sheet in the sheet conveyance direction that can process in the folding apparatus, which reduces the size of the folding apparatus. Therefore, when the leading edge of the sheet contacts the second conveyer, an end portion of the sheet remains the image forming apparatus.

Next, as illustrated in FIG. 19C, after the first forward and reverse rotation roller 13 rotates forward to convey the sheet until the trailing edge of the sheet passes through the fork between the through-conveyance path W1 and the switchback conveyance path W3, the controller stops rotation of the first forward and reverse rotation roller 13. Next, the film 18 serving as a bifurcating claw returns to the original shape, and the first forward and reverse rotation roller 13 rotates in reverse to perform switchback conveying of the sheet toward the switchback conveyance path W3.

As illustrated in FIG. 20A, when the leading edge of the sheet in the regular conveyance that is the conveyance in the predetermined direction reaches a position before a nip between the first forward and reverse rotation roller 13 and the pressing roller 14 or is sandwiched by the first forward and reverse rotation roller 13 and the pressing roller 14, the controller stops the switchback conveying and waits until the following sheet is conveyed.

As illustrated in FIG. 20B, when the leading edge of the following sheet contacts the second conveyer to correct the skew, the first forward and reverse rotation roller 13 and the switchback conveyance roller pair 17 rotate forward to overlay the following sheet on the preceding sheet and convey the overlaid sheets. Subsequently, when the overlaid sheets move by a predetermined amount from the nip between the first forward and reverse rotation roller 13 and the pressing roller 14, the first forward and reverse rotation roller 13 rotates in reverse to form a bend of the overlaid sheets between the entry roller pair 10 and the second conveyer, and the bend that is the folded back portion enters the nip between the first folding roller 12 and the first forward and reverse rotation roller 13 as illustrated in FIG. 12C. As a result, the overlay and folding processing is performed, and the first folded portion is formed on the plurality of sheets.

Subsequently, the second folded portion is formed by two types of folding processing, that is, folding processing illustrated in FIGS. 21A and 21B and folding processing illustrated in FIGS. 22A to 22C.

In the folding processing illustrated in FIGS. 21A and 21B, as illustrated in FIG. 21A, the first forward and reverse rotation roller 13 rotates forward when the sheets pass through the nip between the first forward and reverse rotation roller 13 and the pressing roller 14. As illustrated in FIG. 21B, this causes the sheets to bend between the entry roller pair 10 and the nip between the first forward and reverse rotation roller 13 and the pressing roller 14, and this bent portion of the sheets that becomes the folded back portion enters the nip between the first forward and reverse rotation roller 13 and the pressing roller 14 to fold the folded back portion of the overlaid sheets and form the second folded portion.

The folding processing illustrated in FIGS. 22A to 22C is similar to the folding processing described in the present embodiment. That is, the sheets are conveyed to the second forward and reverse rotation roller pair 16 in a state illustrated in FIG. 22A, and, as illustrated in FIG. 22B, the second forward and reverse rotation roller pair 16 rotates in reverse when the sheets move by a predetermined amount from the position of the nip between the second forward and reverse rotation roller pair 16. Subsequently, as illustrated in FIG. 22C, the overlaid sheets are bent between the first forward and reverse rotation roller 13 and the second forward and reverse rotation roller pair 16. This bent portion of the sheets that becomes the folded back portion enters the nip between the first forward and reverse rotation roller 13 and the second folding roller 15 to fold the folded back portion of the overlaid sheets and form the second folded portion.

Since the folding apparatus 1 according to the third variation does not include the skew correction roller pair, the number of parts can be reduced, and the cost of the folding apparatus and the size of the folding apparatus can be reduced.

Fourth Variation

Figure 23:
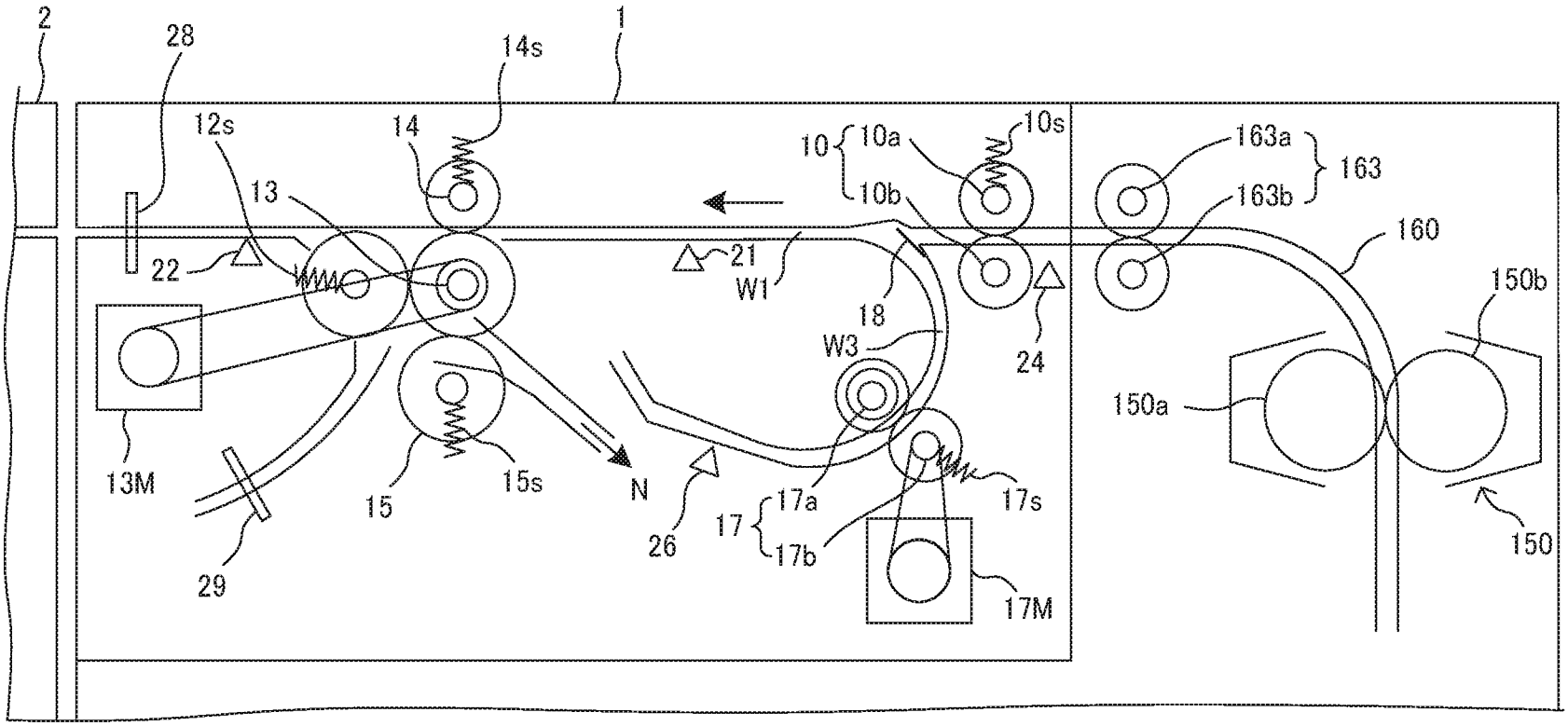
FIG. 23 is a schematic configuration diagram illustrating the folding apparatus of a fourth variation.

FIG. 23 is a schematic configuration diagram illustrating the folding apparatus according to a fourth variation.

As illustrated in FIG. 23, the folding apparatus according to the fourth variation counterchanges positions of the first forward and reverse rotation roller 13 and the first folding roller 12 in the folding apparatus according to the second variation.

In the fourth variation, the leading edge of the sheet contacts the nip between the first forward and reverse rotation roller 13 and the pressing roller 14 to correct the skew. Subsequently, the sheet is bent between the stopper 28 and the nip between the first forward and reverse rotation roller 13 and the pressing roller 14, and this bent portion of the sheet that becomes the folded back portion enters the nip between the first forward and reverse rotation roller 13 and the first folding roller 12 to form the first folded portion.

The sheet that passes through the nip between the first forward and reverse rotation roller 13 and the first folding roller 12 is conveyed to the left side in FIG. 23. Subsequently, the first folded portion of the sheet contacts the second stopper 29, and the sheet is bent between the second stopper 29 and the nip between the first forward and reverse rotation roller 13 and the first folding roller 12, and this bent portion of the sheet that becomes the folded back portion enters the nip between the first forward and reverse rotation roller 13 and the second folding roller 15 to form the second folded portion. The folded sheet is ejected in a direction of arrow N in FIG. 23.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA), and conventional circuit components arranged to perform the recited functions.

What is claimed is:

1. A sheet processing apparatus comprising:

a sheet conveyance path extending from an entry portion;

a skew correction roller pair configured to, contact a leading edge of a sheet conveyed in a first direction from the entry portion, and correct skew of the sheet when the skew correction roller pair does not rotate;

a receiving path branched from the sheet conveyance path configured to receive the sheet; and a folding mechanism configured to fold a plurality of overlaid sheets skew-corrected by the skew correction roller pair, the folding mechanism including, a first conveyer configured to convey the sheet, a second conveyer downstream from the first conveyer in a sheet conveyance direction, and a folded portion former configured to form a folded portion on the street, wherein the second conveyer is configured to form a bent portion in the sheet by conveying the sheet held by the first conveyer and the second conveyer in a second direction opposite to the first direction, and the folded portion former is configured to fold the sheet by receiving the bent portion in the sheet, and wherein at least one of the first conveyer and the second conveyer serves as the skew correction roller pair.

2. The sheet processing apparatus according to claim 1, further comprising:

a conveyance roller configured to convey the sheet, wherein the skew correction roller pair is configured to, convey a preceding sheet to the receiving path in the second direction, and correct skew of a following sheet conveyed by the conveyance roller, and wherein the conveyance roller and the skew correction roller pair are configured to, overlay the following sheet on the preceding sheet conveyed to the receiving path, and convey the preceding sheet and the following sheet.

3. The sheet processing apparatus according to claim 2, wherein the skew correction roller pair is configured to hold the preceding sheet sandwiched by the skew correction roller pair when skew of the following sheet is corrected.

4. The sheet processing apparatus according to claim 2, wherein the skew correction roller pair is configured to hold the preceding sheet contacting the skew correction roller pair when skew of the following sheet is corrected.

5. The sheet processing apparatus according to claim 1, wherein a sheet conveyance length from the entry portion to the skew correction roller pair is smaller than a maximum size of the sheet.

6. An image forming system comprising:

an image forming apparatus configured to form an image on a sheet, and the sheet processing apparatus according to claim 1.

7. The image forming system according to claim 6, wherein the sheet processing apparatus is in an internal ejection section of the image forming apparatus configured to eject the sheet on which an image is formed in a space inside the image forming apparatus.

8. The sheet processing apparatus according to claim 1, wherein the skew correction roller pair is configured to convey the skew-corrected sheet in a second direction opposite the first direction, and the receiving path is configured to receive the sheet conveyed in the second direction.

9. An image forming system comprising:

an image forming apparatus configured to form an image on a sheet;

a sheet processing apparatus in an internal ejection section of the image forming apparatus configured to eject the sheet in a space inside the image forming apparatus, the sheet processing apparatus including:

a sheet conveyance path extending from an entry portion, the entry portion coupled to the image forming apparatus;

a skew correction roller pair configured to, contact a leading edge of the sheet conveyed in a first direction from the entry portion, and correct skew of the sheet when the skew correction roller pair does not rotate;

a receiving path branched from the sheet conveyance path between the entry portion and the skew correction roller pair configured to receive the sheet;

a plurality of conveyance rollers configured to convey the sheet; and circuitry configured to control the plurality of conveyance rollers to convey the sheet into the sheet processing apparatus and the skew correction roller pair to convey the sheet to the receiving path, after the leading edge of the sheet contacts the skew correction roller pair.

10. The image forming system according to claim 9, further comprising a folding mechanism configured to overlay and fold a plurality of sheets skew-corrected by the skew correction roller pair.

11. The image forming system according to claim 10, wherein the folding mechanism includes:

a first conveyer configured to convey the sheet;

a second conveyer downstream from the first conveyer in a sheet conveyance direction; and a folded portion former configured to form a folded portion on the sheet, wherein the circuitry is configured to, control the second conveyer to form a bent portion in the sheet by conveying the sheet held by the first conveyer and the second conveyer in a second direction opposite to the first direction, and control the first conveyer, the second conveyer, and the folded portion former to convey the bent portion of the sheet into the folded portion former, and wherein at least one of the first conveyer and the second conveyer serves as the skew correction roller pair.

12. The image forming system according to claim 9, wherein the circuitry is configured to, control the skew correction roller pair to convey a preceding sheet to the receiving path, control the plurality of conveyance rollers and the skew correction roller pair to convey a following sheet and correct skew of the following sheet, and control the skew correction roller pair to overlay the following sheet on the preceding sheet conveyed to the receiving path.

13. The image forming system according to claim 12, wherein the circuitry is configured to control the skew correction roller pair to hold the preceding sheet sandwiched by the skew correction roller pair when skew of the following sheet is corrected.

14. The image forming system according to claim 12, wherein the circuitry is configured to control the skew correction roller pair to hold the preceding sheet contacting the skew correction roller pair when skew of the following sheet is corrected.

15. The image forming system according to claim 9, wherein a sheet conveyance length from the entry portion to the skew correction roller pair is smaller than a maximum size of the sheet.

16. The image forming system according to claim 9, wherein the skew correction roller pair is configured to convey the skew-corrected sheet in a second direction opposite the first direction, the receiving path is configured to receive the sheet conveyed in the second direction, and the circuitry is configured to control the skew correction roller pair to convey the sheet to the receiving path in the second direction.

17. A sheet processing apparatus comprising:

a sheet conveyance path extending from an entry portion;

a skew correction roller pair configured to, contact a leading edge of a sheet conveyed in a first direction from the entry portion, and correct skew of the sheet when the skew correction roller pair does not rotate;

a receiving path branched from the sheet conveyance path configured to receive the sheet; and a conveyance roller configured to convey the sheet, wherein the skew correction roller pair is configured to, convey a preceding sheet to the receiving path in a second direction opposite the first direction, and correct skew of a following sheet conveyed by the conveyance roller, and wherein the conveyance roller and the skew correction roller pair are configured to, overlay the following sheet on the preceding sheet conveyed to the receiving path, and convey the preceding sheet and the following sheet.

18. The sheet processing apparatus according to claim 17, wherein the skew correction roller pair is configured to hold the preceding sheet sandwiched by the skew correction roller pair when skew of the following sheet is corrected.

19. The sheet processing apparatus according to claim 17, wherein the skew correction roller pair is configured to hold the preceding sheet contacting the skew correction roller pair when skew of the following sheet is corrected.

20. The sheet processing apparatus according to claim 17, wherein a sheet conveyance length from the entry portion to the skew correction roller pair is smaller than a maximum size of the sheet.

21. An image forming system comprising:

an image forming apparatus configured to form an image on a sheet, and the sheet processing apparatus according to claim 17.

22. The image forming system according to claim 21, wherein the sheet processing apparatus is in an internal ejection section of the image forming apparatus configured to eject the sheet on which an image is formed in a space inside the image forming apparatus.

* * * * *